US006634343B2

(12) United States Patent
Kano et al.

(10) Patent No.: US 6,634,343 B2
(45) Date of Patent: Oct. 21, 2003

(54) EVAPORTED FUEL PROCESSOR AND FAULT DIAGNOSING APPARATUS THEREFOR

(75) Inventors: Masao Kano, Gamagoori (JP); Nobuhiko Koyama, Nagoya (JP); Hideki Kato, Toyohashi (JP); Noriyasu Amano, Nishio (JP); Hideaki Itakura, Nishio (JP); Naoya Kato, Nishio (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 8 days.

(21) Appl. No.: 09/996,779

(22) Filed: Nov. 30, 2001

(65) Prior Publication Data

US 2002/0066440 A1 Jun. 6, 2002

(30) Foreign Application Priority Data

Dec. 1, 2000 (JP) ..... 2000-367117
Jan. 25, 2001 (JP) ..... 2001-016845
Jun. 25, 2001 (JP) ..... 2001-190724

(51) Int. Cl.[7] ..... F02M 55/02; F02M 37/04
(52) U.S. Cl. ..... 123/520
(58) Field of Search ..... 123/516, 518, 123/519, 520

(56) References Cited

U.S. PATENT DOCUMENTS 5,377,644 A * 1/1995 Krohm ..... 123/520
5,460,141 A * 10/1995 Denz et al. ..... 123/520
5,553,577 A * 9/1996 Denz ..... 123/198 D
5,715,799 A * 2/1998 Blomquist et al. ..... 123/520
5,975,062 A 11/1999 Bonse et al. ..... 123/519
5,992,396 A * 11/1999 Krimmer et al. ..... 123/520
6,014,958 A * 1/2000 Miwa et al. ..... 123/520
2002/0162457 A1 * 11/2002 Hyodo et al. ..... 123/519

* cited by examiner

*Primary Examiner*—Thomas N. Moulis
(74) *Attorney, Agent, or Firm*—Nixon & Vanderhye P.C.

(57) ABSTRACT

An evaporated fuel adsorbed by an adsorbing member of a canister is compulsively desorbed by driving of a purge pump and is introduced into an intake passage of an internal combustion engine. In this instance, intake pulsation of the intake passage of an internal combustion engine is introduced into a driving chamber of the purge pump and a partition is moved, so that the capacity of a pump chamber is varied. In other words, the purge pump conducts its pump operation by utilizing the movement of the partition resulting from the introduction of intake pulsation of the intake passage of the internal combustion engine, and a power loss can be thus reduced. When a pressure difference is small between the intake pressure inside the intake passage of the internal combustion engine and the pressure on the canister side, too, a desired purge flow rate can be secured in accordance with the operating condition of the internal combustion engine.

18 Claims, 27 Drawing Sheets

EVAPORTED FUEL PROCESSOR AND FAULT DIAGNOSING APPARATUS THEREFOR

BACKGROUND OF THE INVENTION

1. Field of the Invention

This invention relates to an evaporated fuel processor of an internal combustion engine. More particularly, this invention relates to an evaporated fuel processor for preventing emission of an evaporated fuel generated in a fuel feed system of a vehicle into the open air, and to a fault diagnosing apparatus for such a processor.

2. Description of the Related Art

In a conventional internal combustion engine for a vehicle, a technology is known that temporarily adsorbs an evaporated fuel generated inside a fuel tank by use of an adsorbing member of a canister, introduces the evaporated fuel thus adsorbed from the canister into an intake passage in accordance with a driving condition and purges the evaporated fuel to prevent emission of the fuel into the open air.

As a prior art reference related with this technology, mention can be made of EP (European Patent) No. 0864741B1. This reference discloses a technology that introduces the evaporated fuel adsorbed to the canister into the intake passage of the internal combustion engine by use of an electric pump and purges it.

Since the prior art technology described above uses the electric pump, it can purge the evaporated fuel generated inside the fuel tank from the canister into the intake passage when the pressure difference between an intake pressure inside the intake passage and the pressure on the canister side is small, and also in the case of an inter-cylinder direct injection type engine in which the negative intake pressure cannot be acquired easily. However, since driving by means of a separate device such as an electric pump is necessary, the power loss rises to a certain extent, and this exerts an adverse influence on the fuel cost.

Recently, direct injection engines and other lean-burn engines that execute combustion using a mixture leaner than the stoichiometric air-fuel ratio are often used in order to improve the fuel cost. It is known that the leaner the air-fuel ratio in such engines, the smaller becomes the negative intake pressure. The evaporated fuel processor utilizes the negative intake pressure for delivering the evaporated fuel adsorbed by the canister into the intake pipe. Because the intake pipe negative pressure is small in the engines of the kind described above, however, the canister cannot be purged sufficiently, and the evaporated fuel remaining in the canister is likely to leak and to be emitted into the air.

To solve this problem, Japanese Unexamined Patent Publication (Kokai) No. 11-30158 describes a technology that arranges a purge pump inside a purge passage and delivers the evaporated fuel into the intake pipe. This reference discloses a motor driven-type purge pump that changes a purge amount to the intake pipe in accordance with the rotating speed of an electric motor, and a fuel driven-type purge pump that rotates a shaft by utilizing the flow of the fuel pressure-fed from the fuel tank into the injector and changes the purge amount into the intake pipe in accordance with the fuel flow.

However, the motor driven-type purge pump using the electric motor involves the problem of the increase of the fuel cost resulting from consumption of electric power.

Though capable of solving the problem of the increase of the fuel cost, the fuel driven-type purge pump is not free from another problem that a part of the pressure generated by a fuel pump is lost because a part of the fuel branches from the fuel pipe and flows towards the purge pump during purge pump driving, and the fuel pressure of a fuel distribution pipe (delivery pipe) changes between purge pump driving and not driving, thereby exerting an influence on the fuel injection by the injector. Moreover, problems occur in that driving of the purge pump is limited during the driving condition where the fuel consumption amount is great, in order to secure the fuel amount to be sent to the delivery pipe, and that the pressure-feed capacity of the purge pump is restricted depending on the flow rate of the fuel (fuel consumption amount).

SUMMARY OF THE INVENTION

The present invention has been completed to solve the problems described above. It is, therefore, a first object of the present invention to provide an evaporated fuel processor of an internal combustion engine capable of reducing a power loss and securing a required purge flow rate in accordance with an operating condition of an internal combustion engine even when a pressure difference is small between an intake pressure inside an intake passage and a pressure in a canister.

It is a second object of the present invention to provide an evaporated fuel processor capable of restricting the influence on a fuel system and always exhibiting a stable purge capacity irrespective of an engine operating condition, and a fault diagnosing apparatus for the evaporated fuel processor.

It is a third object of the present invention to provide an evaporated fuel processor capable of compulsively desorbing an evaporated fuel from a fuel adsorbing layer by utilizing a purge pump without consuming electric power and without exerting an influence on the fuel injection by an injector.

In an evaporated fuel processor according to one aspect of the present invention, an evaporated fuel adsorbed by an adsorbing member in a canister is compulsively desorbed by driving of a purge pump and is introduced into an intake passage of an internal combustion engine. In this instance, an intake pulsation of an intake passage or an exhaust pulsation of an exhaust passage of the internal combustion engine is introduced into a driving chamber of the purge pump and a partition is moved, thereby varying a capacity of a purge chamber. Because the purge pump executes its pumping operation by utilizing the movement of the partition brought forth by the introduction of the intake pulsation of the intake passage or the exhaust pulsation of the exhaust passage of the internal combustion engine, the power loss can be reduced. Even when a pressure difference is small between the intake pressure inside the intake passage of the internal combustion engine and the pressure on the canister side, too, a required purge flow rate can be secured in accordance with the operating condition of the internal combustion engine.

In the evaporated fuel processor according to another aspect of the present invention, air forced into the canister by the driving by the purge pump compulsively desorbs the evaporated fuel adsorbed by the adsorbing member of the canister from the adsorbing member, and it is introduced into the intake passage of the internal combustion engine. In this instance, an intake pulsation of the intake passage or an exhaust pulsation of the exhaust passage of the internal combustion engine is introduced into a driving chamber of the purge pump with a predetermined valve operation, and the partition is moved. Consequently, the capacity of the pump chamber is varied. Because the purge pump executes its pumping operation by utilizing the movement of the partition brought forth by the introduction of the intake pulsation of the intake passage or the exhaust pulsation of the exhaust passage of the internal combustion engine, the power loss can be reduced. Even when a pressure difference is small between the intake pressure inside the intake passage of the internal combustion engine and the pressure on the canister side, too, a required purge flow rate can be secured in accordance with the operating condition of the internal combustion engine.

In the evaporated fuel processor according to another aspect of the present invention, there is disposed a purge pump that is driven by utilizing fuel pressure. In the purge pump, the fuel pressurized by a fuel pump is introduced and it reciprocates a movable member by the pressure of this fuel and compulsively purges the evaporated fuel adsorbed by the canister. Therefore, when the processor of this invention is employed for an engine having a low negative intake pressure (or not having a negative pressure), too, the evaporated fuel inside the canister is appropriately purged to the engine intake pipe. Since the fuel pressure is utilized to drive the purge pump in the present invention, the processor of the present invention does not invite a fluctuation of the fuel pressure due to leaking of the fuel or an adverse influence on the fuel system, unlike the conventional apparatus described in the prior art reference described above that utilizes the flow of the fuel to drive the purge pump. Since the fuel pressure (the fuel pressure by the fuel pump), as the driving source of the purge pump, is kept substantially constant irrespective of the operating condition of the engine, the purge pump can always be driven stably. As a result, the influences on the fuel system can be restricted, and the purge capacity can always be exhibited stably irrespective of the engine operating condition.

In the evaporated fuel processor according to still another aspect of the present invention, the purge air is introduced into a first chamber in the purge pump, the pressurized fuel is introduced into a second chamber by the fuel pump, and the movable member is reciprocated in accordance with the pressure of the fuel introduced into the second chamber. In this case, because the capacity of the first chamber changes with the reciprocation of the movable member, purge air is sucked into the first chamber and is thereafter delivered. Because the movable member partitions the first and second chambers under the sealed state in the present invention, leaking of the fuel pressurized by the fuel pump can be reduced to minimum. Consequently, the influences on fuel injection can be minimized.

In this specification, the purge air is a mixed gas of air introduced from the open air side in order to purge a canister and evaporated fuel purged by the canister (purged gas).

In a fault diagnosing apparatus for the evaporated fuel processor according to still another aspect of the present invention, a portion extending from the fuel tank to the intake pipe through the evaporated fuel passage is closed and this closed portion is then pressurized or evacuated by the purge pump. Any abnormality of the evaporated fuel processor is detected in this state, on the basis of the pressure change in the closed space. In this case, if any abnormality exists in the evaporated fuel processor inclusive of the canister and the purge pump, the evaporated fuel leaks out and can be detected as a pressure change in the closed space. Therefore, fault judgment can be easily practiced.

In the evaporated fuel processor according to still another aspect of the present invention, the negative intake pressure occurring in the intake pipe when the throttle of the engine is closed or opened, is utilized effectively, and this negative intake pressure is used as the power source for driving the purge pump. The purge pump, driven by the negative intake pressure as the power source without consuming electric power and without exerting adverse influences on fuel injection of the injector can compulsively desorb the evaporated fuel from the fuel adsorbing layer, and can deliver the evaporated fuel so desorbed from the fuel adsorbing layer into the intake pipe through the purge passage.

The present invention may be more fully understood from the description of preferred embodiments thereof, as set forth below, together with the accompanying drawings.

DESCRIPTION OF THE PREFERRED EMBODIMENTS

Hereinafter, preferred embodiments of the present invention will be explained.

Embodiment 1

Figure 1:
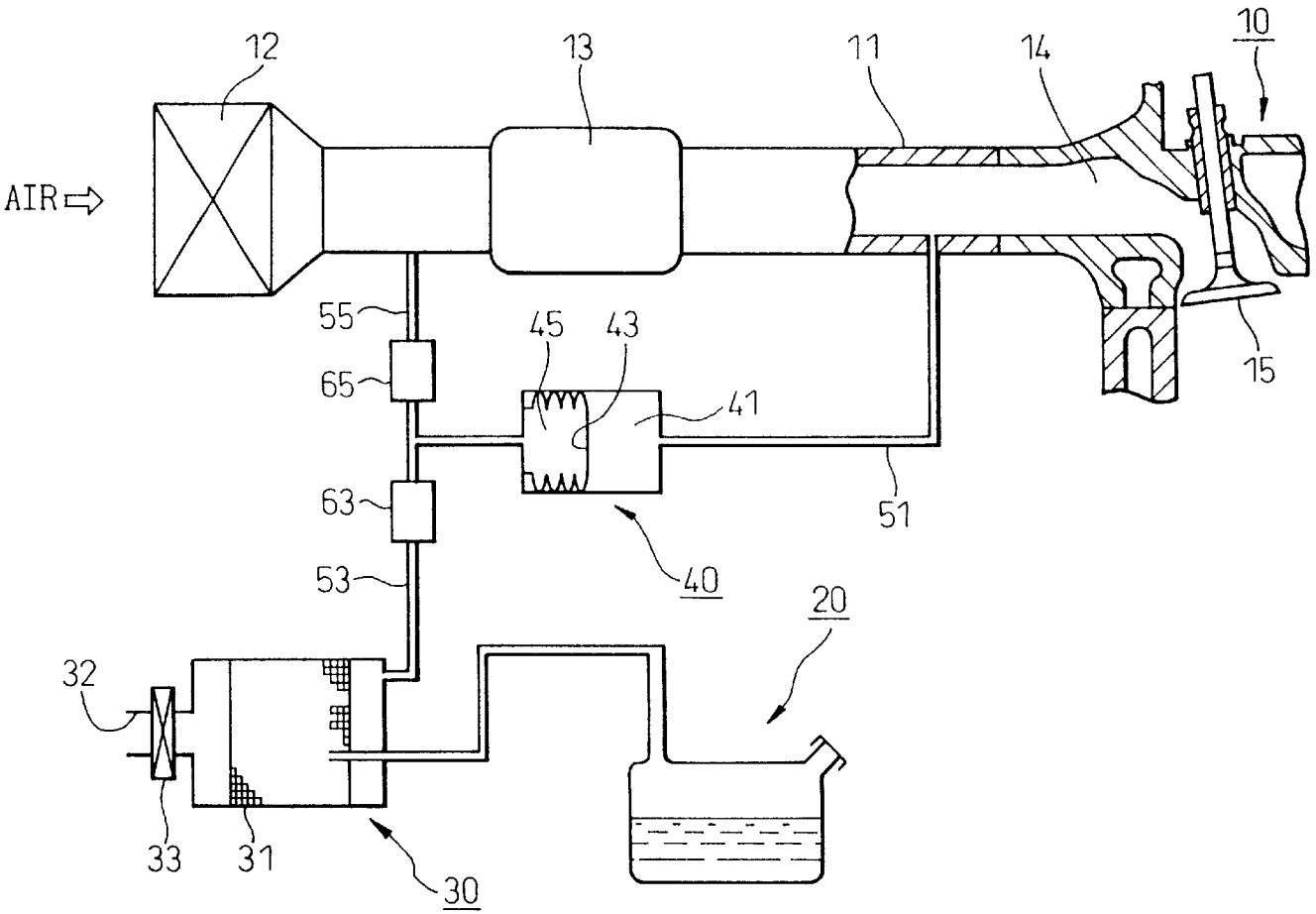
FIG. 1 is a schematic view showing a construction of an evaporated fuel processor of an internal combustion engine according to a first embodiment of the present invention.

FIG. 1 is a schematic view showing a construction of an evaporated fuel processor of an internal combustion engine according to the first embodiment of the present invention.

Referring to FIG. 1, an intake passage 11 and an exhaust passage (not shown) are connected to an internal combustion engine 10. An air cleaner 12 for filtrating air is arranged on the upstream side of the intake passage 11. Air is sucked into the intake passage 11 through this air cleaner 12. The air thus sucked into the intake passage 11 is supplied to each combustion chamber (not shown) from an intake port 14 of each cylinder of the internal combustion engine 10 through a surge tank 13 when an intake valve 15 is open.

A fuel tank 20 storing a liquid fuel (gasoline) is connected to a canister 30. An adsorbing member 31 made of active carbon is packed into this canister 30. Therefore, the adsorbing member 31 of the canister 31 sequentially adsorbs the evaporated fuel generated inside the fuel tank 20.

The evaporated fuel thus adsorbed to the adsorbing member 31 of the canister 30 is compulsively desorbed from the adsorbing member 31 when a purge pump 40 is driven, passes through a communication passage 53 and is introduced into the intake passage 11 from a communication passage 55 connected to the upstream side of the surge tank 13 in accordance with the operating condition of the internal combustion engine 10.

A purge valve 33 is provided to an open air hole 32 formed in the canister 30 so that the open air hole 32 can be released to the open air, whenever necessary. In this embodiment, the detail of the feed passage of the liquid fuel supplied from the fuel tank 20 to the internal combustion engine 10 is omitted.

The purge pump 40 comprises a driving chamber 41 connected by a communication passage 51 to the intake passage 11 of the internal combustion engine 10, a pump chamber 45 arranged adjacent to the driving chamber 41 and connected to an intermediate part of communication passages 53 and 55 that connect the canister 30 to the intake passage 11, and a bellows-like partition 43 capable of moving while separating the driving chamber 41 from the pump chamber 45. A check valve 63 is disposed at an intermediate part of the communication passage 53 connecting the canister 30 to the pump chamber 45 of the purge pump 40. This check valve 63 functions as a one-way valve for checking the flow of the evaporated fuel in an opposite direction when the direction from the canister 30 to the pump chamber 45 is regarded as a normal direction. Another check valve 65 is disposed at an intermediate part of the communication passage 55 for connecting the pump chamber 45 of the purge pump 40 to the intake passage 11. This check valve 65 functions as a one-way valve for checking the flow of the evaporated fuel in an opposite direction when the direction from the pump chamber 45 to the intake passage 11 is the normal direction.

Next, the operation of the embodiment of FIG. 1 will be explained with reference to FIG. 2.

Figure 2:
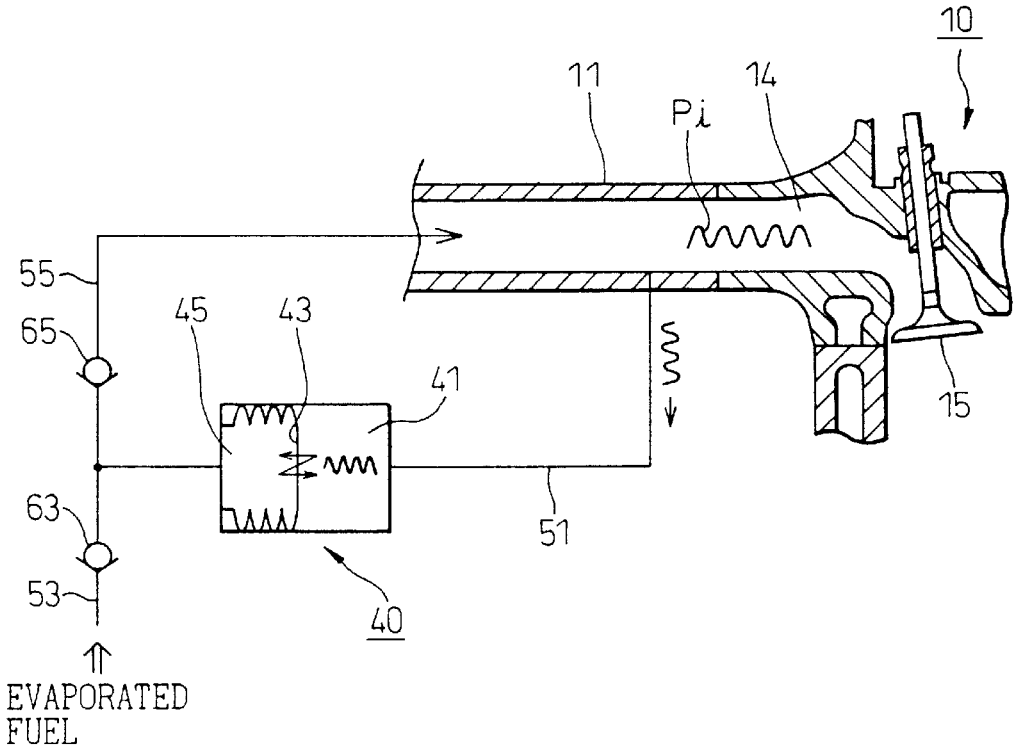
FIG. 2 is an explanatory view showing an operation when intake pulsation is introduced in FIG. 1.

Intake pulsation Pi of the intake passage 11 occurring in accordance with the operating condition of the internal combustion engine 10 is introduced into the driving chamber 41 of the purge pump 40 through the communication passage 51 as shown in FIG. 2. Then, the partition 43 of the purge pump 40 is allowed to move to the right and left in accordance with the cycle of the positive pressure/negative pressure of this intake pulsation Pi. In other words, the partition 43 moves to the left when the intake pulsation Pi has a positive pressure and to the right when the intake pulsation Pi has a negative pressure. Due to the shift of the partition 43 to the right, the evaporated fuel from the canister 30 is sucked into the pump chamber 45 of the purge pump 40 through the communication passage 53. Due to the shift of the partition 43 to the left, the evaporated fuel sucked into the pump chamber 45 is delivered into the intake passage 11 of the internal combustion engine 10 through the communication passage 55 and then through the check valve 65.

As the operation of the purge pump 40 shown in FIG. 2 described above is repeated, the evaporated fuel adsorbed by the adsorbing member 31 of the canister 30 is compulsively desorbed and is introduced into the intake passage 11 of the internal combustion engine 10.

As described above, the evaporated fuel processor of the internal combustion engine according to this embodiment includes the canister 30 for accommodating the adsorbing member 31 that adsorbs the evaporated fuel generated inside the fuel tank 20, and the purge pump 40 for compulsively desorbing the evaporated fuel adsorbed by the adsorbing member 31 of the canister 30 and introducing the evaporated fuel into the intake passage 11 of the internal combustion engine 10. The purge pump 40 includes the driving chamber 41 for introducing the intake pulsation Pi of the intake passage 11 of the internal combustion engine 10, the pump chamber 45 adjacent to the driving chamber 41 and connected to the intermediate part of the communication passages 53 and 55 between the canister 30 and the intake passage 10 of the internal combustion engine 10, and the partition 43 for separating the driving chamber 41 from the pump chamber 45 and capable of varying the capacity proportion of both of these chambers 41 and 45. When the partition 43 moves due to the introduction of the intake pulsation Pi into the driving chamber 41, the evaporated fuel from the canister 30 is sucked into the pump chamber 45 and is delivered from the pump chamber 45 into the intake passage 11 of the internal combustion engine 10.

The purge pump 40 of the evaporated fuel processor of the internal combustion engine according to this embodiment sucks the evaporated fuel into the pump chamber 45 with the valve operation of the check valve 63 resulting from the movement of the partition 43 when the negative pressure of the intake pulsation Pi of the intake passage 11 of the internal combustion engine 10 is introduced into the driving chamber 41, and delivers the evaporated fuel from the pump chamber 45 with the valve operation of the check valve 65 resulting from the movement of the partition 43 when the positive pressure is introduced into the driving chamber 41.

Consequently, the evaporated fuel adsorbed by the adsorbing member 31 of the canister 30 is compulsively desorbed and is introduced into the intake passage 11 of the internal combustion engine 10 by the driving operation of the purge pump 40. In this instance, the intake pulsation Pi of the intake passage 11 of the internal combustion engine 10 is introduced into the driving chamber 41 of the purge pump 40 and the partition 43 moves with the result that the capacity of the pump chamber 45 is varied. In other words, the purge pump 40 conducts a pumping operation by utilizing the movement of the partition 43 resulting from the introduction of the intake pulsation Pi into the intake passage 11 of the internal combustion engine 10 and the power loss can be reduced. When the pressure difference is small between the intake pressure inside the intake passage 11 of the internal combustion engine 10 and the pressure on the canister side 30, too, a required purge flow rate can be secured in accordance with the operating condition of the internal combustion engine 10. Further, because the intake pulsation Pi is utilized, the intake pulsation Pi is reduced and the filling efficiency of fresh air can be improved.

Embodiment 2

Figure 3:
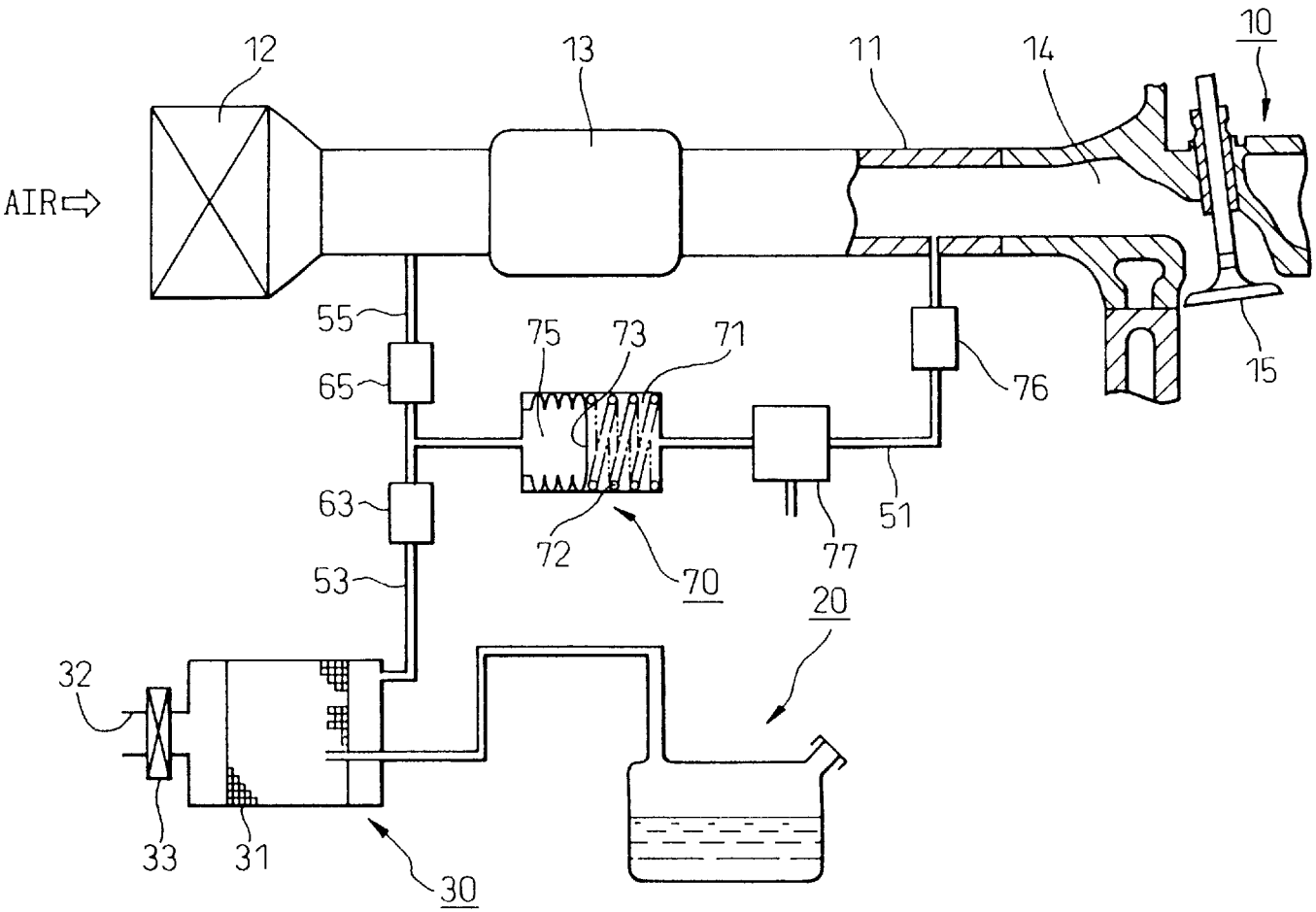
FIG. 3 is a schematic view showing a construction of an evaporated fuel processor of an internal combustion engine according to the second embodiment of the present invention.

FIG. 3 is a schematic view showing a construction of an evaporated fuel processor of an internal combustion engine according to the second embodiment of the present invention. In the drawing, like reference numerals are used to identify like constituent elements as in the first embodiment, and the detailed explanation of such members will be omitted and the difference will be primarily explained.

In FIG. 3, the driving chamber 71 of the purge pump 70 is connected to the intake passage 11 of the internal combustion engine 10 through the communication passage 51. A reed valve 76 as a one-way valve for introducing a negative pressure is disposed at an intermediate part of this communication passage 51 on the side of the intake passage 11. A negative pressure relief valve 77 as a three-way valve is disposed on the side of the driving chamber 71. A bellows-like partition 73, capable of moving while separating the driving chamber 71 from the pump chamber 75, is provided to the purge pump 70. A coil spring 72 is disposed in the purge pump 70 on the side of the driving chamber 71 to urge the partition 73 leftward and to expand the driving chamber 71.

Next, the operation of the embodiment of FIG. 3 will be explained with reference to FIGS. 4 and 5.

Figure 4:
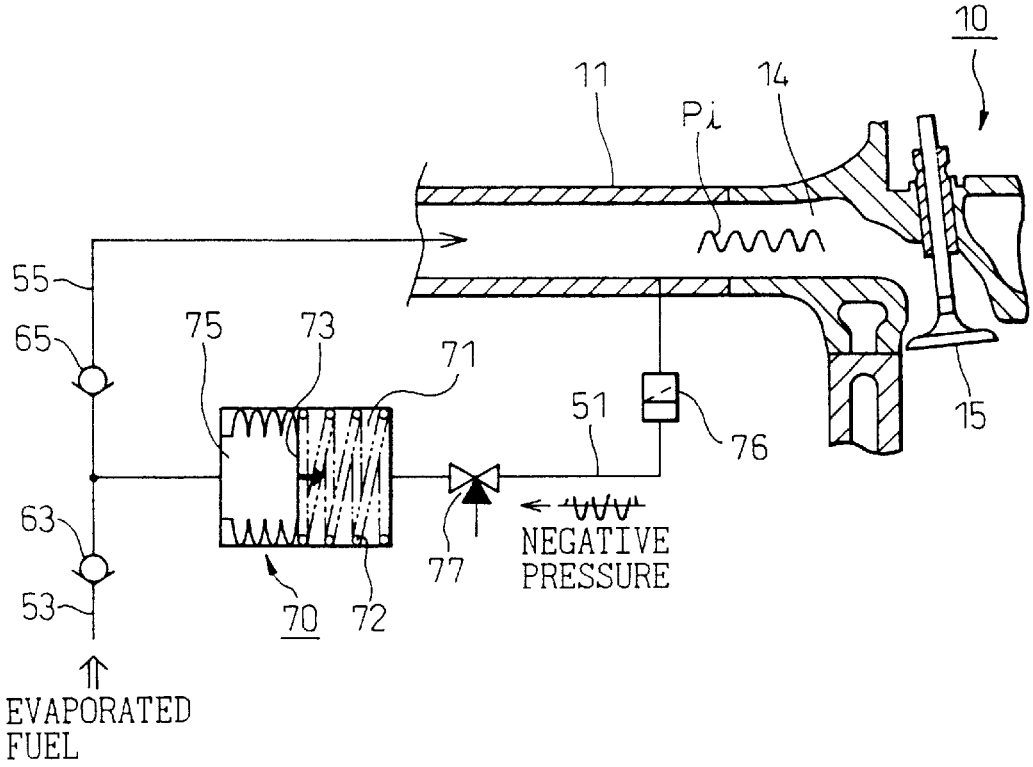
FIG. 4 is an explanatory view showing an operation when a negative pressure of intake pulsation is introduced in FIG. 3.

When the intake pulsation Pi of the intake passage 11 occurring in accordance with the operating condition of the internal combustion engine 10 passes through the reed valve 76 disposed in the communication passage 51 as shown in FIG. 4, only the negative pressure of the intake pulsation Pi is introduced into the communication passage 51. At this time, the negative pressure relief valve 77 is under the communication state on the side of the communication passage 51. Therefore, the negative pressure inside the communication passage 51 passing through the reed valve 76 passes further through the negative pressure relief valve 77 and reaches the driving chamber 71 of the purge pump 70. Then, a pressure difference develops between the driving chamber 71 of the purge pump 70 and the pump chamber 75, and the partition 73 is moved to the right against the force of the coil spring 72, thereby increasing the capacity of the pump chamber 75. Consequently, the evaporated fuel from the canister 30 flows inside the communication passage 53 and is sucked into the pump chamber 75 of the purge pump 70 through the check valve 63.

Figure 5:
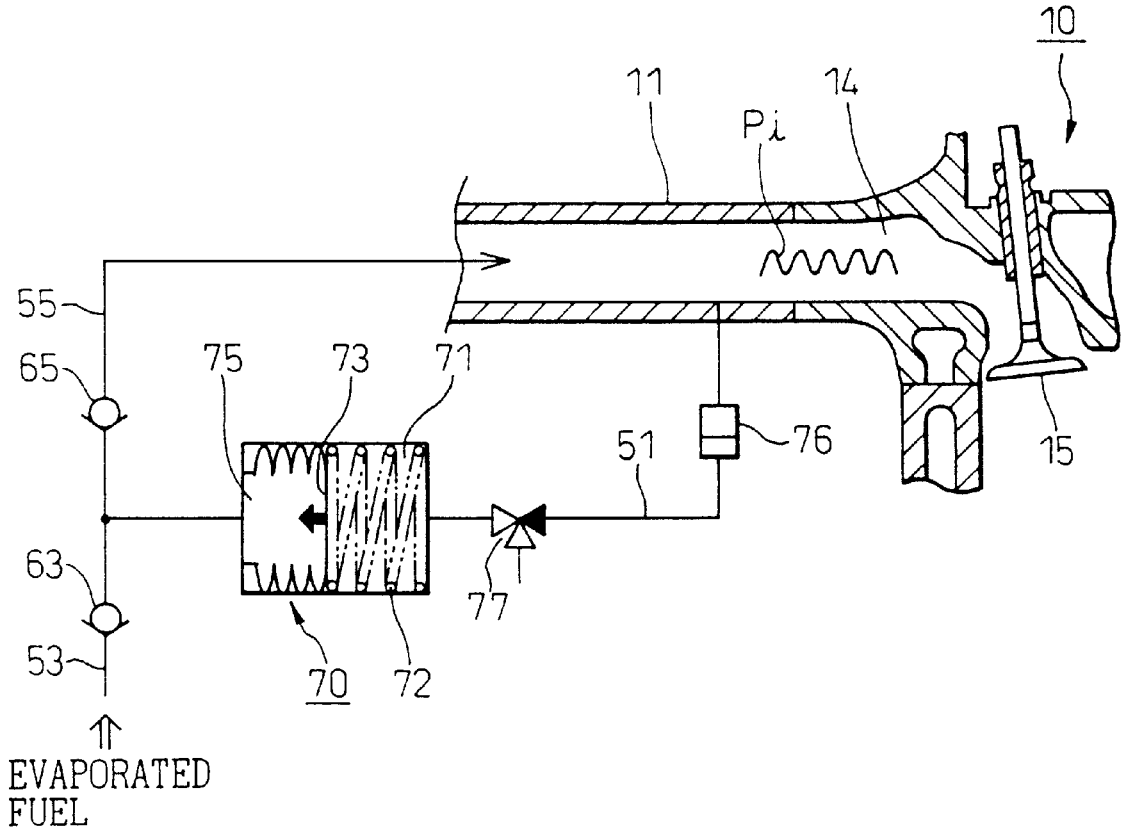
FIG. 5 is an explanatory view showing an operation when the negative pressure of intake pulsation is released in FIG. 3.

Next, as shown in FIG. 5, the negative pressure relief valve 77 closes the reed valve (76) side in accordance with the operating condition of the internal combustion engine 10 in such a fashion as to release the driving chamber (71) side of the purge pump 70 to the open air. Since the driving chamber (71) side of the purge pump 70 attains the atmospheric pressure, the partition 73 is moved to the left by the force of the coil spring 72, reducing the capacity of the pump chamber 75. Therefore, the evaporated fuel sucked into the pump chamber 75 is delivered into the intake passage 11 of the internal combustion engine 10 through the communication passage 55 and through the check valve 65.

As the operation of the purge pump 70 shown in FIGS. 4 and 5 is repeated as described above, the evaporated fuel adsorbed to the adsorbing member 31 of the canister 30 is compulsively desorbed and is introduced into the intake passage 11 of the internal combustion engine 10.

As described above, the purge pump 70 of the evaporated fuel processor of the internal combustion engine according to this embodiment sucks the evaporated fuel into the pump chamber 75 by means of the movement of the partition 73 when only the negative pressure of the intake pulsation Pi of the intake passage 11 of the internal combustion engine 10 is introduced into the driving chamber 71 with the valve operations of the reed valve 76 and the negative pressure relief valve 77, and delivers the evaporated fuel from the pump chamber 75 with the return of the partition 73 brought forth by the spring force of the coil spring 72 when the negative pressure is released with the valve operation of the negative pressure relief valve 77.

Therefore, the evaporated fuel adsorbed by the adsorbing member 31 of the canister 30 is compulsively desorbed by the driving operation of the purge pump 70, and is introduced into the intake passage 11 of the internal combustion engine 10. In this instance, only the negative pressure of the intake pulsation Pi of the intake passage 11 of the internal combustion engine 10 is introduced into the driving chamber 71 of the purge pump 70 with the valve operations of the reed valve 76 and the negative pressure relief valve 77, moving thereby the partition 73. When this negative pressure is released with the valve operation of the negative pressure relief valve 77, the partition 73 is caused to return by the spring force of the coil spring 72, varying thereby the capacity proportion of the pump chamber 75. In other words, the purge pump 70 conducts its pump operation by utilizing the movement of the partition 73 resulting from the introduction of the negative pressure of the intake pulsation Pi of the intake passage 11 of the internal combustion engine 10 to thereby reduce the power loss. When the pressure difference is small between the intake pressure inside the intake passage 11 of the internal combustion engine 10 and the pressure on the side of the canister 30, too, a desired purge flow rate can be secured in accordance with the operating condition of the internal combustion engine 10.

Embodiment 3

Figure 6:
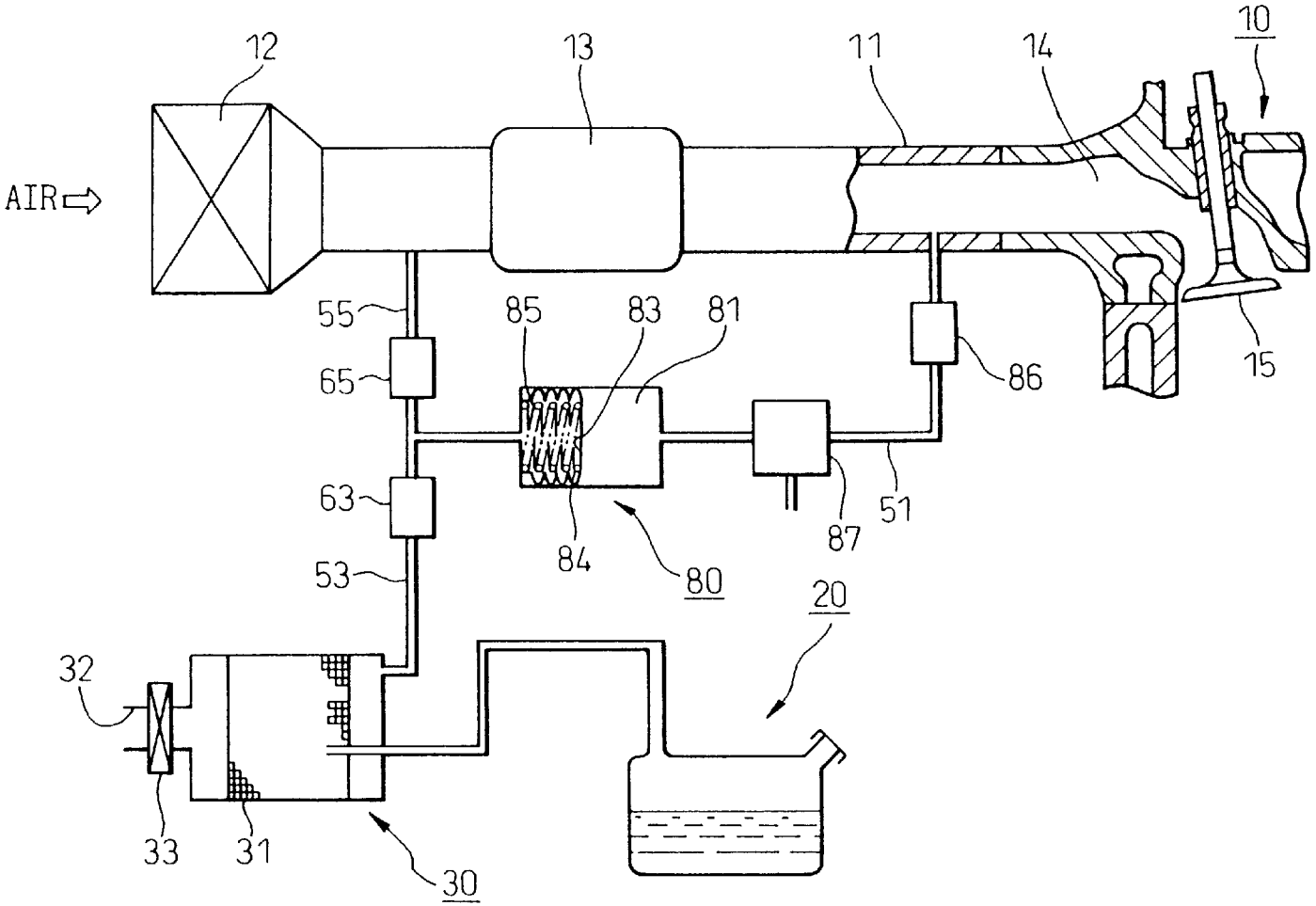
FIG. 6 is a schematic view showing a construction of an evaporated fuel processor of an internal combustion engine according to the third embodiment of the present invention.

FIG. 6 is a schematic view showing a construction of an evaporated fuel processor of an internal combustion engine according to the third embodiment of the present invention. In the drawing, like reference numerals are used to identify like constituent elements as in the embodiment described above, and the detailed explanation of such members will be omitted but the difference will be primarily explained.

In FIG. 6, the driving chamber 81 of the purge pump 80 is connected to the intake passage 11 of the internal combustion engine 10 through the communication passage 51. A check valve 86 as a one-way valve for introducing a positive pressure is disposed at an intermediate part of this communication passage 51 on the side of the intake passage 11. A positive pressure relief valve 87 as a three-way valve is disposed on the side of the driving chamber 81. A bellows-like partition 83 capable of moving while separating the driving chamber 81 from the pump chamber 85 is provided to the purge pump 80. A coil spring 84 is disposed in the purge pump 80 on the side of the pump chamber 85 of the purge pump 80 to urge rightward the partition 83 and to expand the pump chamber (85) side.

Next, the operation of the embodiment of FIG. 6 will be explained with reference to FIGS. 7 and 8.

Figure 7:
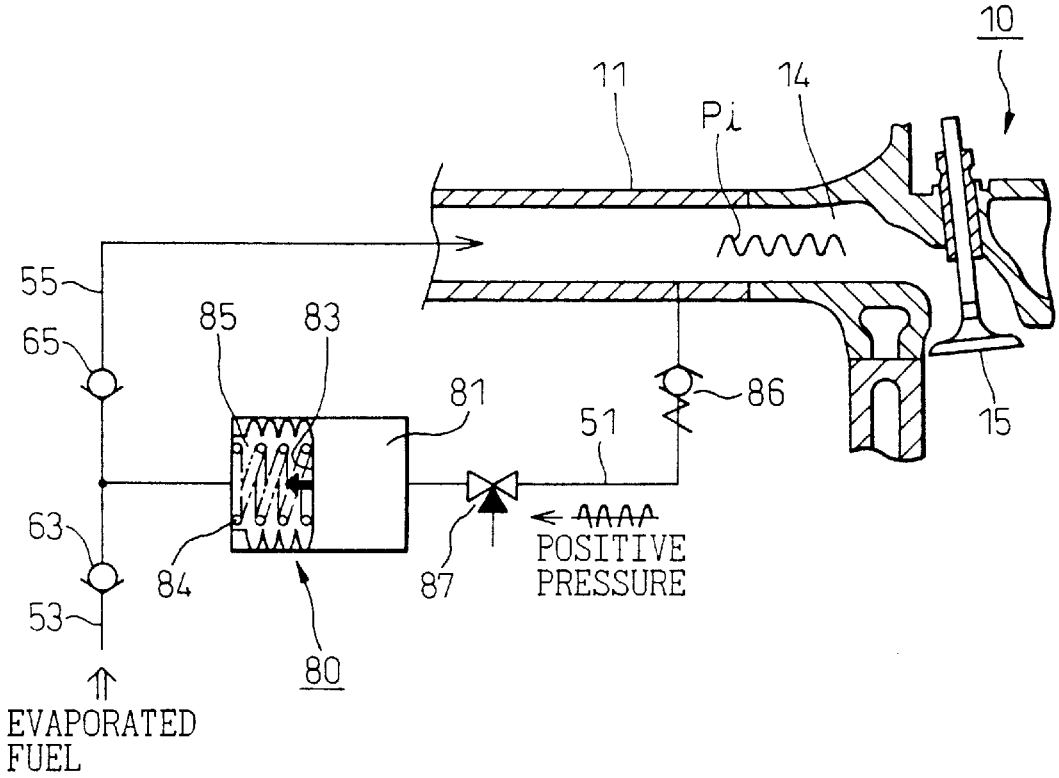
FIG. 7 is an explanatory view showing an operation when a positive pressure of intake pulsation is introduced in FIG. 6.

When the intake pulsation Pi of the intake passage 11 occurring in accordance with the operating condition of the internal combustion engine 10 passes through the check valve 86 disposed in the communication passage 51 as shown in FIG. 7, only the positive pressure of the intake pulsation Pi is introduced into the communication passage 51. At this time, the positive pressure relief valve 87 is under the communication state on the side of the communication passage 51. Therefore, the positive pressure inside the communication passage 51 passing through the check valve 86 passes further through the positive pressure relief valve 87 and reaches the driving chamber 81 of the purge pump 80. Then, a pressure difference develops between the driving chamber 81 of the purge pump 80 and the pump chamber 85, and the partition 83 is moved to the left against the urging force of the coil spring 84, thereby decreasing the capacity of the pump chamber 85. Consequently, the evaporated fuel sucked into the pump chamber 85 flows inside the communication passage 55 and is delivered into the intake passage 11 of the internal combustion engine 10 through the check valve 65 and the communication passage 55.

Figure 8:
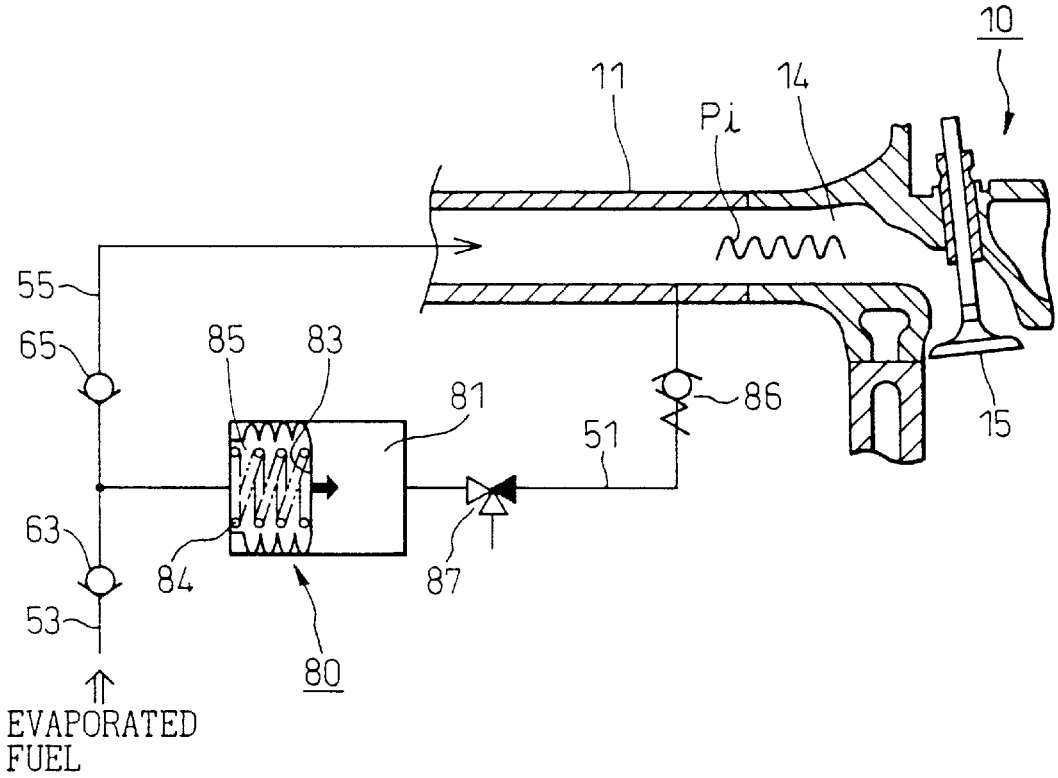
FIG. 8 is an explanatory view showing an operation when the positive pressure of intake pulsation is released in FIG. 6.

Next, as shown in FIG. 8, the positive pressure relief valve 87 is switched in accordance with the operating condition of the internal combustion engine 10 so that the driving chamber (81) side of the purge pump 80 is released to the open air. At this time, the check valve 86 is closed. As the driving chamber (81) side of the purge pump 80 reaches atmospheric pressure, the partition 83 is moved to the right by the force of the coil spring 84, increasing the capacity of the pump chamber 85. Therefore, the evaporated fuel from the canister 30 is sucked into the pump chamber 85 of the purge pump 80 through the communication passage 53 and through the check valve 63.

As the operation of the purge pump 80 shown in FIGS. 7 and 8 is repeated as described above, the evaporated fuel adsorbed to the adsorbing member 31 of the canister 30 is compulsively desorbed and is introduced into the intake passage 11 of the internal combustion engine 10.

As described above, the purge pump 80 of the evaporated fuel processor of the internal combustion engine according to this embodiment sends the evaporated fuel from the pump chamber 85 by means of the movement of the partition 83 when only the positive pressure of the intake pulsation Pi of the intake passage 11 of the internal combustion engine 10 is introduced into the driving chamber 81 with the valve operations of the check valve 86, and sucks the evaporated fuel into the pump chamber 85 with the return of the partition 83 brought forth by the spring force of the coil spring 84 when the positive pressure is released with the valve operation of the positive pressure relief valve 87.

Therefore, the evaporated fuel adsorbed by the adsorbing member 31 of the canister 30 is compulsively desorbed by the driving operation of the purge pump 80, and is introduced into the intake passage 11 of the internal combustion engine 10. In this instance, only the positive pressure of the intake pulsation Pi of the intake passage 11 of the internal combustion engine 10 is introduced into the driving chamber 81 of the purge pump 80 with the valve operations of the check valve 86 and the positive pressure relief valve 87, moving thereby the partition 83. When this positive pressure is released with the valve operation of the positive pressure relief valve 87, the partition 83 is caused to return by the spring force of the coil spring 84, varying thereby the capacity of the pump chamber 85. In other words, the purge pump 80 conducts its pump operation by utilizing the movement of the partition 83 resulting from the introduction of the positive pressure of the intake pulsation Pi of the intake passage 11 of the internal combustion engine 10 to thereby reduce the power loss. When the pressure difference is small between the intake pressure inside the intake passage 11 of the internal combustion engine 10 and the pressure on the side of the canister 30, too, a desired purge flow rate can be secured in accordance with the operating condition of the internal combustion engine 10.

Embodiment 4

Figure 9:
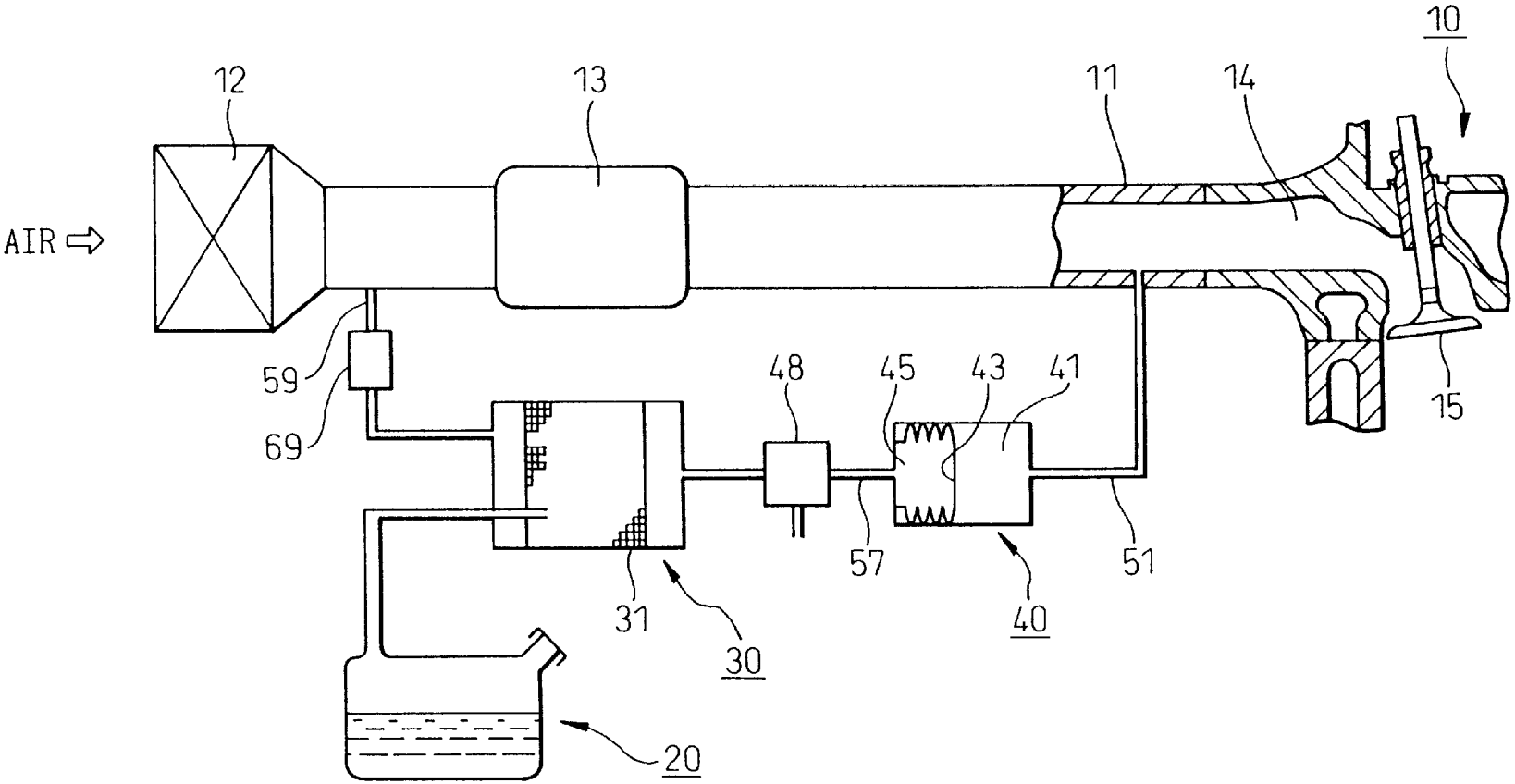
FIG. 9 is a schematic view showing a construction of an evaporated fuel processor of an internal combustion engine according to the fourth embodiment of the present invention.

FIG. 9 is a schematic view showing a construction of an evaporated fuel processor of an internal combustion engine according to the fourth embodiment of the present invention. In the drawing like reference numerals are used to identify like constituent elements, as in the embodiment described above, and the detailed explanation of such members will be omitted but the difference will be primarily explained.

In FIG. 9, the driving chamber 41 of the purge pump 40 is connected to the intake passage 11 of the internal combustion engine 10 through the communication passage 51. The pump chamber 45 of the purge pump 40 is connected to the open-air side of the canister 30 through the communication passage 57. An atmospheric pressure relief valve 48 as a one-way valve for releasing the pump chamber 45 to the open air is disposed at an intermediate part of this communication passage 57. A bellows-like partition 43 capable of moving while separating the driving chamber 41 from the pump chamber 45 is provided to the purge pump 40. A check valve 69 is disposed in a communication passage 59 for delivering the evaporated fuel from the canister 30 to the intake passage 11.

Next, the operation of the embodiment of FIG. 9 will be explained with reference to FIGS. 10 and 11.

The intake pulsation Pi of the intake passage 11 occurring in accordance with the operating condition of the internal combustion engine 10 is introduced into the driving chamber 41 of the purge pump 40 through the communication passage 51 as shown in FIG. 9. Then, the partition 43 of the purge pump 40 is moved to the right and left in accordance with the cycle of the positive pressure/negative pressure of the intake pulsation Pi.

Figure 10:
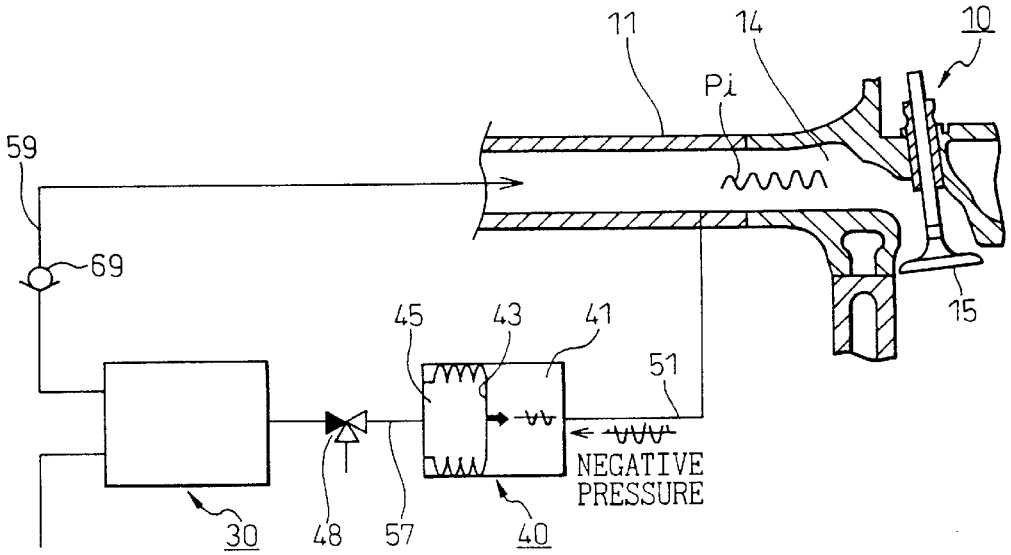
FIG. 10 is an explanatory view showing an operation when a negative pressure of intake pulsation is introduced in FIG. 9.

When the negative pressure of the intake pulsation Pi is introduced into the driving chamber 41 as shown in FIG. 10, the partition 43 is shifted to the right. As the atmospheric pressure relief valve 48 is released to the open air during the shift of the partition 43 to the right, the external air is introduced into the pump chamber 45 of the purge pump 40.

Figure 11:
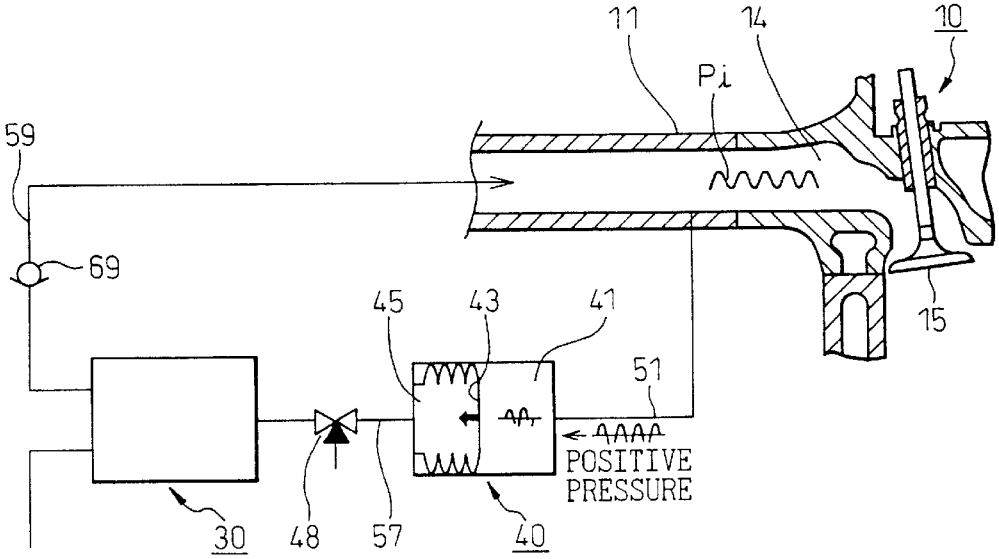
FIG. 11 is an explanatory view showing an operation when a positive pressure of intake pulsation is introduced in FIG. 9.

When the positive pressure of the intake pulsation Pi is introduced into the driving chamber 41 as shown in FIG. 11, the partition 43 is shifted to the left. Since the atmospheric pressure relief valve 48 is closed to the open air during the shift of the partition 43 to the left, the air sucked into the pump chamber 45 is packed into the communication passage 57, the atmospheric pressure relief valve 48 and the canister 30.

As the operation of the purge pump 40 shown in FIGS. 10 and 11 is repeated as described above, the evaporated fuel adsorbed to the adsorbing member 31 of the canister 30 is compulsively desorbed by the packed air and is introduced into the intake passage 11 of the internal combustion engine 10 from the canister 30 through the communication passage 59 and then through the check valve 69.

As described above, the evaporated fuel processor of the internal combustion engine according to this embodiment includes the canister 30 for accommodating the adsorbing member 31 adsorbing the evaporated fuel generated inside the fuel tank 20 and the purge pump 40 for compulsively desorbing the evaporated fuel adsorbed by the adsorbing member 31 of the canister 30 and delivering the evaporated fuel into the intake passage 11 of the internal combustion engine 10. The purge pump 40 includes the driving chamber 41 for introducing the intake pulsation Pi of the intake passage 11 of the internal combustion engine 10, the pump chamber 45 adjacent to the driving chamber 41 and connected to the open-air side of the canister 30, and the partition 43 for separating the driving chamber 41 from the pump chamber 45 and capable of varying the capacity of both of these chambers 41 and 45. When the partition 43 is allowed to move due to the introduction of the intake pulsation Pi of the intake passage 11 of the internal combustion engine 10 into the driving chamber 41, the external air is sucked into the pump chamber 45 and the air inside the pump chamber 45 is packed into the canister 30, so that the evaporated fuel is delivered from the canister 30 into the intake passage 11 of the internal combustion engine 10.

The purge pump 40 of the evaporated fuel processor of the internal combustion engine according to this embodiment sucks the external air into the pump chamber 45 with the valve operation of the atmospheric pressure relief valve 48 with the movement of the partition 43 caused by the introduction of the negative pressure of the intake pulsation Pi of the intake passage 11 of the internal combustion engine 10, and moves the air of the pump chamber 45 into the canister 30 with the valve operation of the atmospheric pressure relief valve 48 with the movement of the partition 43 caused by the introduction of the positive pressure into the driving chamber 41.

Therefore, the evaporated fuel adsorbed by the adsorbing member 31 of the canister 30 is compulsively desorbed by the air moving into the canister 30 by the driving operation of the purge pump 40, and is introduced into the intake passage 11 of the internal combustion engine 10. In this instance, only the intake pulsation Pi of the intake passage 11 of the internal combustion engine 10 is introduced into the driving chamber 41 of the purge pump 40 with the valve operations of the atmospheric pressure relief valve 48, moving thereby the partition 43 and varying the capacity of the pump chamber 45. In other words, the purge pump 40 conducts its pump operation by utilizing the movement of the partition 43 resulting from the introduction of the intake pulsation Pi of the intake passage 11 of the internal combustion engine 10 to thereby reduce the power loss. When the pressure difference is small between the intake pressure inside the intake passage 11 of the internal combustion engine 10 and the pressure on the side of the canister 30, too, a desired purge flow rate can be secured in accordance with the operating condition of the internal combustion engine 10.

Embodiment 5

Figure 12:
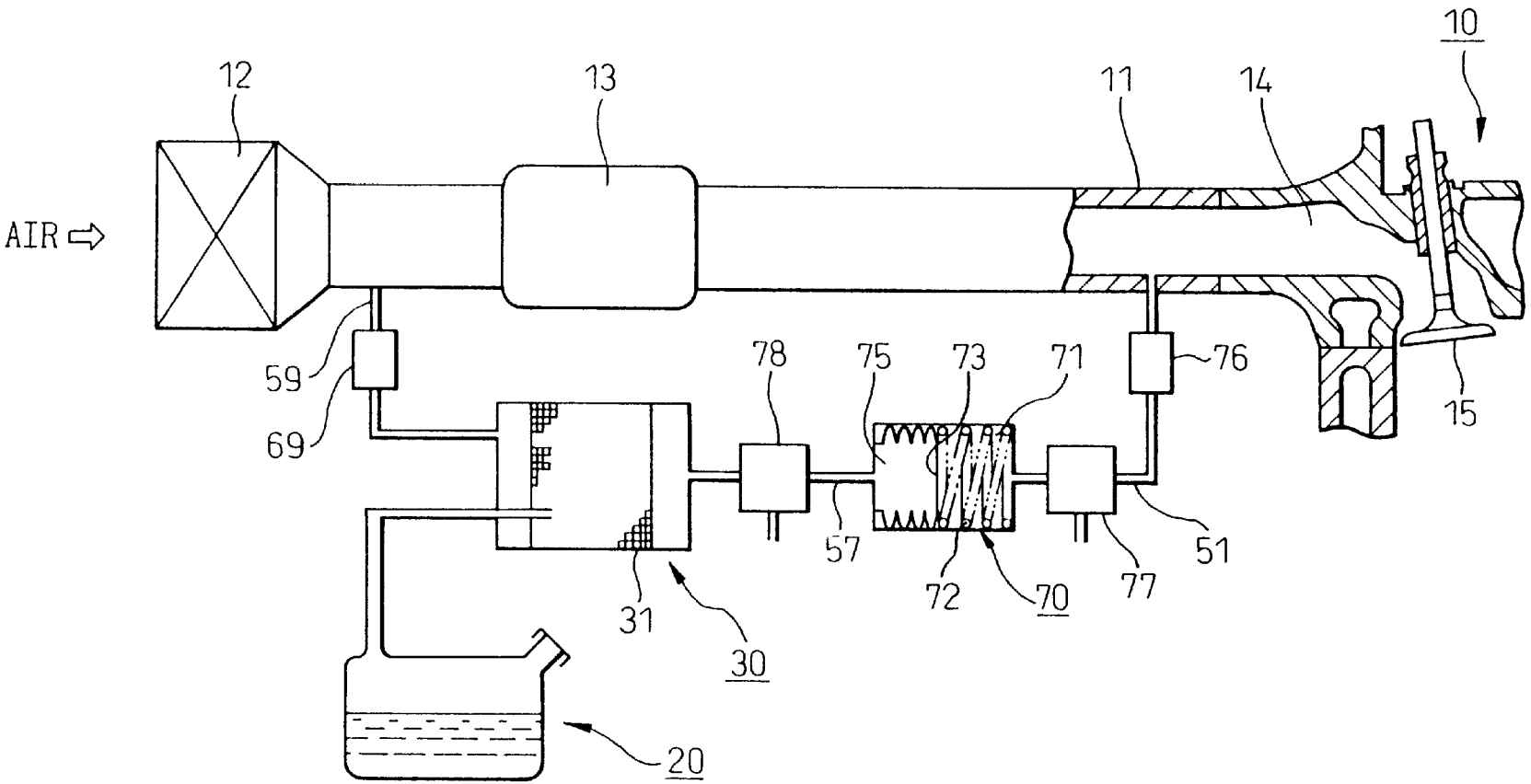
FIG. 12 is a schematic view showing a construction of an evaporated fuel processor of an internal combustion engine according to the fifth embodiment of the present invention.

FIG. 12 is a schematic view showing a construction of an evaporated fuel processor of an internal combustion engine according to the fifth embodiment of the present invention. In the drawing, like reference numerals are used to identify like constituent elements as in the embodiment described above, and the detailed explanation of such members will be omitted but the difference will be primarily explained.

In FIG. 12, the driving chamber 71 of the purge pump 70 is connected to the intake passage 11 of the internal combustion engine 10 through the communication passage 51. A reed valve 76 as a one-way valve for introducing a negative pressure is disposed at an intermediate part of this communication passage 51 on the side of the intake passage 11. A negative pressure relief valve 77 as a three-way valve is disposed on the side of the driving chamber 71. A bellows-like partition 73 capable of moving while separating the driving chamber 71 from the pump chamber 75 is provided to the purge pump 70. A coil spring 72 is disposed in the purge pump 70 on the side of the driving chamber 71 of the purge pump 70 to urge the partition 73 leftward and to expand the driving chamber (71) side. The pump chamber 75 of the purge pump 70 is connected to the open-air side of the canister 30 through the communication passage 57. An atmospheric pressure relief valve 78 as a three-way valve for releasing the pump chamber 75 to the open air is disposed at an intermediate part of this communication passage 57. A check valve 69 is disposed in a communication passage 59 for delivering the evaporated fuel from the canister 30 to the intake passage 11.

Next, the operation of the embodiment of FIG. 12 will be explained with reference to FIGS. 13 and 14.

Figure 13:
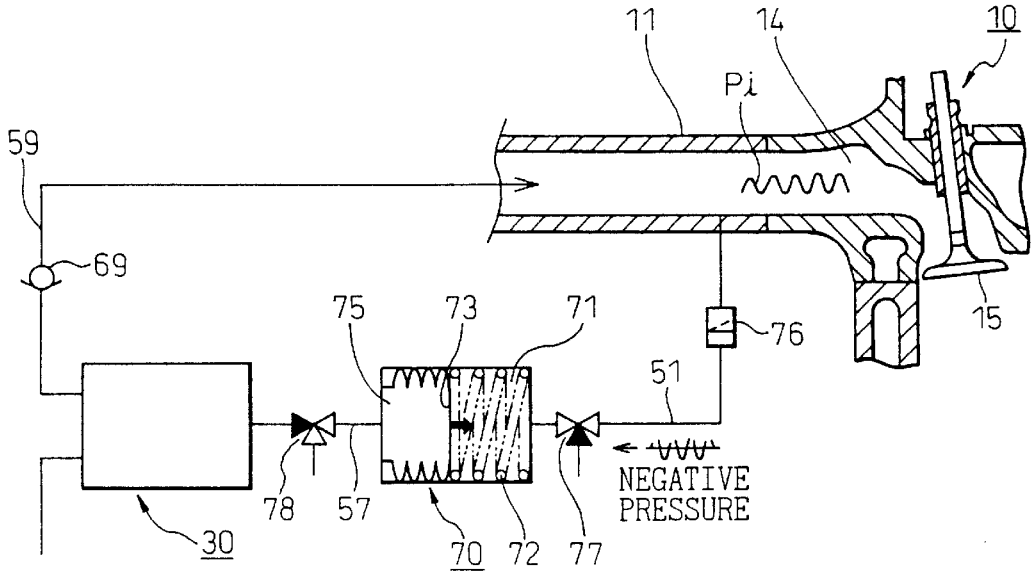
FIG. 13 is an explanatory view showing an operation when a negative pressure of intake pulsation is introduced in FIG. 12.

When the intake pulsation Pi of the intake passage 11 occurring in accordance with the operating condition of the internal combustion engine 10 passes through the reed valve 76 disposed in the communication passage 51 as shown in FIG. 13, only the negative pressure of the intake pulsation Pi is introduced into the communication passage 51. At this time, the negative pressure relief valve 77 is communicating with the communication passage 51. Therefore, only the negative pressure is introduced through the communication passage 51 into the driving chamber 71 of the purge pump 70, and the partition 73 is allowed to move to the right. As the atmospheric pressure relief valve 78 is released to the open air during this rightward movement of the partition, the external air is introduced into the pump chamber 75 of the purge pump 70.

Figure 14:
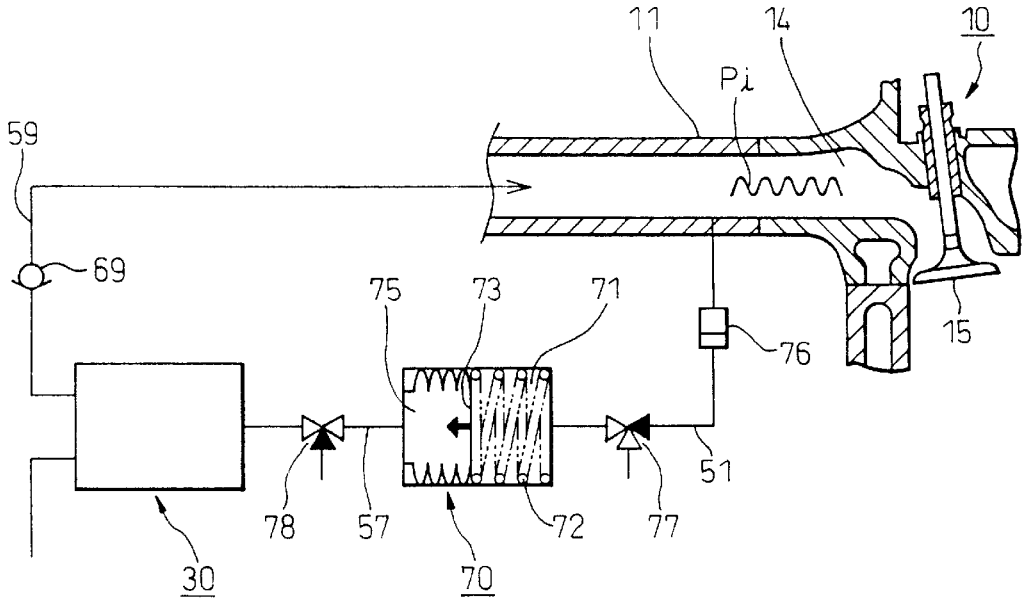
FIG. 14 is an explanatory view showing an operation when the negative pressure of intake pulsation is released in FIG. 12.

Next, as shown in FIG. 14, the positive pressure relief valve 77 is brought into the atmospheric air introduction state in accordance with the operating condition of the internal combustion engine 10, and the partition 73 of the purge pump 70 is moved to the left by the spring force of the coil spring 72. Since the atmospheric pressure relief valve 78 is closed to the open air during this leftward movement of the partition 73, the air sucked into the pump chamber 75 is moved into the canister 30 through the communication passage 57 and the atmospheric pressure relief valve 78.

As the operation of the purge pump 70 shown in FIGS. 13 and 14 is repeated as described above, the evaporated fuel adsorbed to the adsorbing member 31 of the canister 30 is compulsively desorbed by the air and is introduced into the intake passage 11 of the internal combustion engine 10 from the canister 30 through the communication passage 59 and then through the check valve 69.

The purge pump 70 of the evaporated fuel processor of the internal combustion engine according to this embodiment sucks the external air into the pump chamber 75 when the valve operations of the reed valve 76, the negative pressure relief valve 77 and the atmospheric pressure relief valve 78 introduce only the negative pressure of the intake pulsation Pi into the intake passage 11 of the internal combustion engine 10 with the movement of the partition 73, and packs the air inside the pump chamber 75 into the canister 30 when the valve operations of the negative pressure relief valve 77 and the atmospheric pressure relief valve 77 release the negative pressure with the return of the partition 73 due to the spring force of the coil spring 72.

Consequently, the evaporated fuel adsorbed by the adsorbing member 31 of the canister 30 is compulsively desorbed by the air packed into the canister 30 by the driving operation of the purge pump 70, and is introduced into the intake passage 11 of the internal combustion engine 10. In this instance, only the negative pressure of the intake pulsation Pi of the intake passage 11 of the internal combustion engine 10 is introduced into the driving chamber 71 of the purge pump 70 with the valve operations of the reed valve 76, the negative pressure relief valve 77 and the atmospheric pressure relief valve 78 to thereby move the partition 43. When this negative pressure is released by the valve operations of the negative pressure relief valve 77 and the atmospheric pressure relief valve 78, the partition 73 is allowed to return by the spring force of the coil spring 72 with the result that the capacity proportion of the pump chamber 75 is varied. In other words, the purge pump 70 conducts its pump operation by utilizing the movement of the partition 73 resulting from the introduction of the negative pressure of the intake pulsation Pi into the intake passage 11 of the internal combustion engine 10, and the power loss can be reduced. When the pressure difference is small between the intake pressure inside the intake passage 11 of the internal combustion engine 10 and the pressure on the canister side 30, too, the desired purge flow rate can be secured in accordance with the operating condition of the internal combustion engine 10.

Embodiment 6

Figure 15:
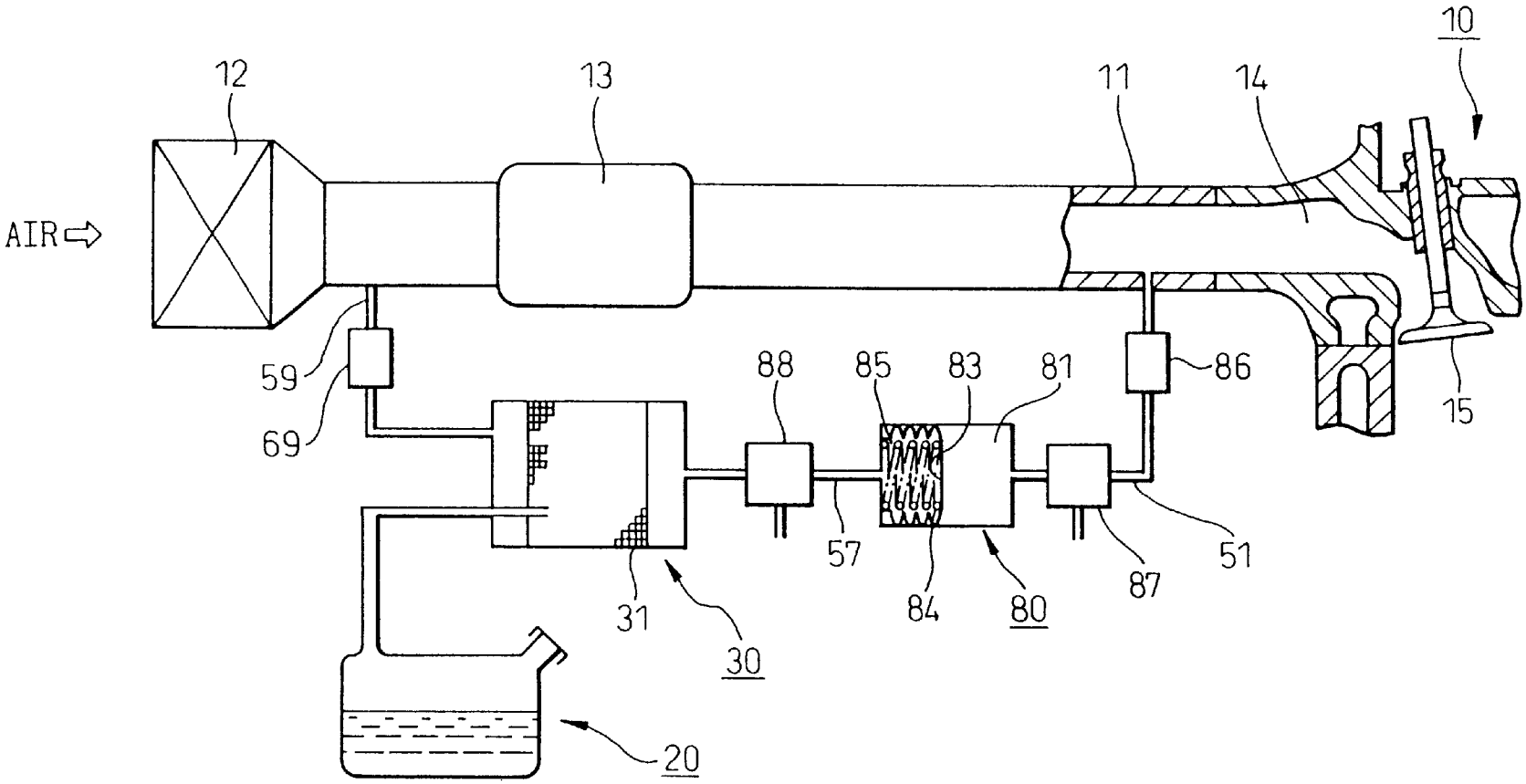
FIG. 15 is a schematic view showing a construction of an evaporated fuel processor of an internal combustion engine according to the sixth embodiment of the present invention.

FIG. 15 is a schematic view showing a construction of an evaporated fuel processor of an internal combustion engine according to the sixth embodiment of the present invention. In the drawing, like reference numerals are used to identify like constituent elements as in the embodiment described above, and the detailed explanation of such members will be omitted but the difference will be primarily explained.

In FIG. 15, the driving chamber 81 of the purge pump 80 is connected to the intake passage 11 of the internal combustion engine 10 through the communication passage 51. A check valve 86 as a one-way valve for introducing a positive pressure is disposed at an intermediate part of this communication passage 51 on the side of the intake passage 11. A positive pressure relief valve 87 as a three-way valve is disposed on the side of the driving chamber 81. A bellows-like partition 83, capable of moving while separating the driving chamber 81 from the pump chamber 85, is provided to the purge pump 80. A coil spring 84 is disposed in the purge pump 80 on the side of the pump chamber 85 to urge the partition 83 rightward and to expand the pump chamber (85) side. The pump chamber 85 of the purge pump 80 is connected to the open-air side of the canister 30 through the communication passage 57. An atmospheric pressure relief valve 88 as a three-way valve for releasing the pump chamber 85 to the open air is disposed at an intermediate part of this communication passage 57. A check valve 69 is disposed in a communication passage 59 for delivering the evaporated fuel from the canister 30 to the intake passage 11.

Next, the operation of the embodiment of FIG. 15 will be explained with reference to FIGS. 16 and 17.

Figure 16:
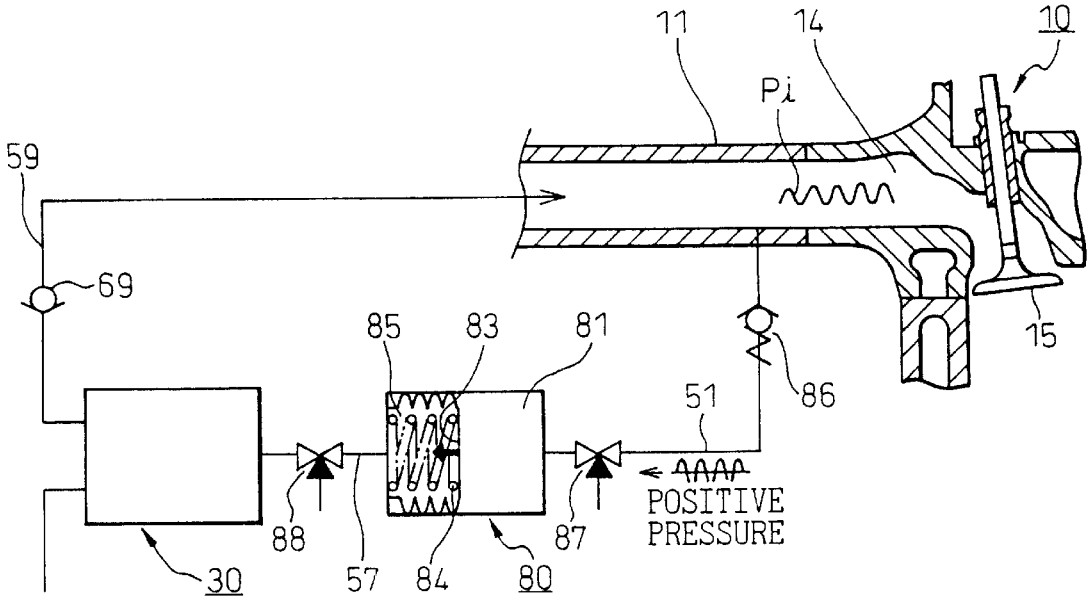
FIG. 16 is an explanatory view showing an operation when a positive pressure of intake pulsation is introduced in FIG. 15.

The intake pulsation Pi of the intake passage 11 occurring in accordance with the operating condition of the internal combustion engine 10 passes through the check valve 86 disposed in the communication passage 51 as shown in FIG. 16, and only the positive pressure of the intake pulsation Pi is introduced into the driving chamber 81 of the purge pump 80 through the communication passage 51, thereby moving the partition 83 to the left. At this time, the atmospheric pressure relief valve 88 is closed to the open air. Therefore, the external air sucked into the pump chamber 85 is moved into the canister 30 through the communication passage 57 and the atmospheric pressure relief valve 88.

Figure 17:
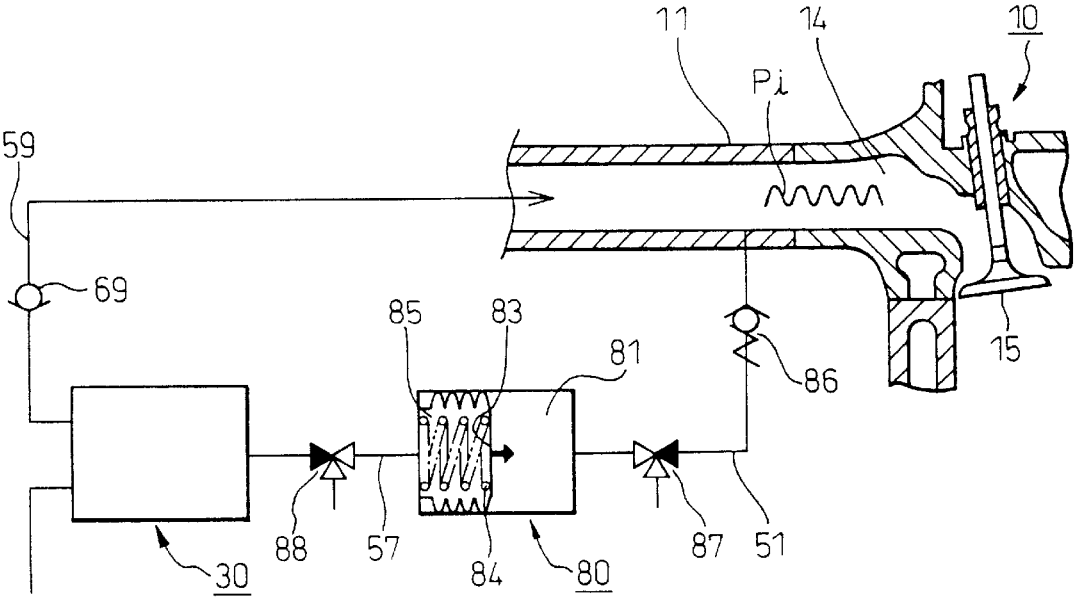
FIG. 17 is an explanatory view showing an operation when the positive pressure of intake pulsation is released in FIG. 15.

Next, as shown in FIG. 17 when the positive pressure relief valve 87 is brought into the atmospheric air introduction state in accordance with the operating condition of the internal combustion engine 10, the partition 83 of the purge pump 80 is shifted to the right by the spring force of the coil spring 84. Since the atmospheric pressure relief valve 88 is released to the open air during this rightward movement of the partition 83, the air is sucked into the pump chamber 75 from the atmospheric pressure relief valve 88 into the pump chamber 75 through the communication passage 57.

As the operation of the purge pump 80 shown in FIGS. 16 and 17 is repeated as described above, the evaporated fuel adsorbed to the adsorbing member 31 of the canister 30 is compulsively desorbed by the air thus packed, and is introduced into the intake passage 11 of the internal combustion engine 10 from the canister 30 through the communication passage 59 and then through the check valve 69.

The purge pump 80 of the evaporated fuel processor of the internal combustion engine according to this embodiment moves the air of the pump chamber 85 into the canister 30 when the valve operations of the check valve 86, the positive pressure relief valve 87 and the atmospheric pressure relief valve 88 introduce only the positive pressure of the intake pulsation Pi into the driving chamber 81 with the movement of the partition 83, and moves the external air into the pump chamber 85 when the valve operations of the positive pressure relief valve 87 and the atmospheric pressure relief valve 88 release the positive pressure with the return of the partition 83 due to the spring force of the coil spring 84.

Consequently, the evaporated fuel adsorbed by the adsorbing member 31 of the canister 30 is compulsively desorbed by the air packed into the canister 30 by the driving operation of the purge pump 80, and is introduced into the intake passage 11 of the internal combustion engine 10. In this instance, only the positive pressure of the intake pulsation Pi of the intake passage 11 of the internal combustion engine 10 is introduced into the driving chamber 81 of the purge pump 80 with the valve operations of the check valve 86, the positive pressure relief valve 87 and the atmospheric pressure relief valve 88 to thereby move the partition 43. When this positive pressure is released by the valve operations of the positive pressure relief valve 87 and the atmospheric pressure relief valve 88, the partition 83 is allowed to return by the spring force of the coil spring 84 with the result that the capacity proportion of the pump chamber 85 is varied. In other words, the purge pump 80 conducts its pump operation by utilizing the movement of the partition 83 resulting from the introduction of the positive pressure of the intake pulsation Pi in the intake passage 11 of the internal combustion engine 10, and the power loss can be reduced. When the pressure difference is small between the intake pressure inside the intake passage 11 of the internal combustion engine 10 and the pressure on the canister side 30, too, the desired purge flow rate can be secured in accordance with the operating condition of the internal combustion engine 10.

In the foregoing embodiments, the bellows-like partition separates the driving chamber of the purge pump from the pump chamber. When the present invention is practiced, however, this construction is not particularly restrictive. In other words, the partition may be those that can separate the driving chamber from the pump chamber and have a shape capable of freely moving.

In the foregoing embodiments, the predetermined force for returning the partition of the purge pump relies on the force of the coil spring, but this construction is not particularly restrictive when the present invention is practiced. For example, it is possible to obtain the predetermined force by elastic deformation of flexible members.

Further, the foregoing embodiments introduce the intake pulsation of the intake passage of the internal combustion engine and drive the purge pump, but this construction is not particularly restrictive, either, when the present invention is practiced. For example, the purge pump can be driven similarly by introducing the exhaust pulsation of the exhaust passage of the internal combustion engine.

Embodiment 7

Next, the seventh embodiment of the present invention will be explained with reference to the drawing. An evaporated fuel processor of this embodiment uses a canister disposed in a fuel system of a car engine, adsorbs once the evaporated fuel (evaporated gas) generated in a fuel tank and then discharges the evaporated fuel into an engine intake system. The constructions and the functions and effects of the evaporated fuel processor and its peripheral devices will be explained.

Figure 18:
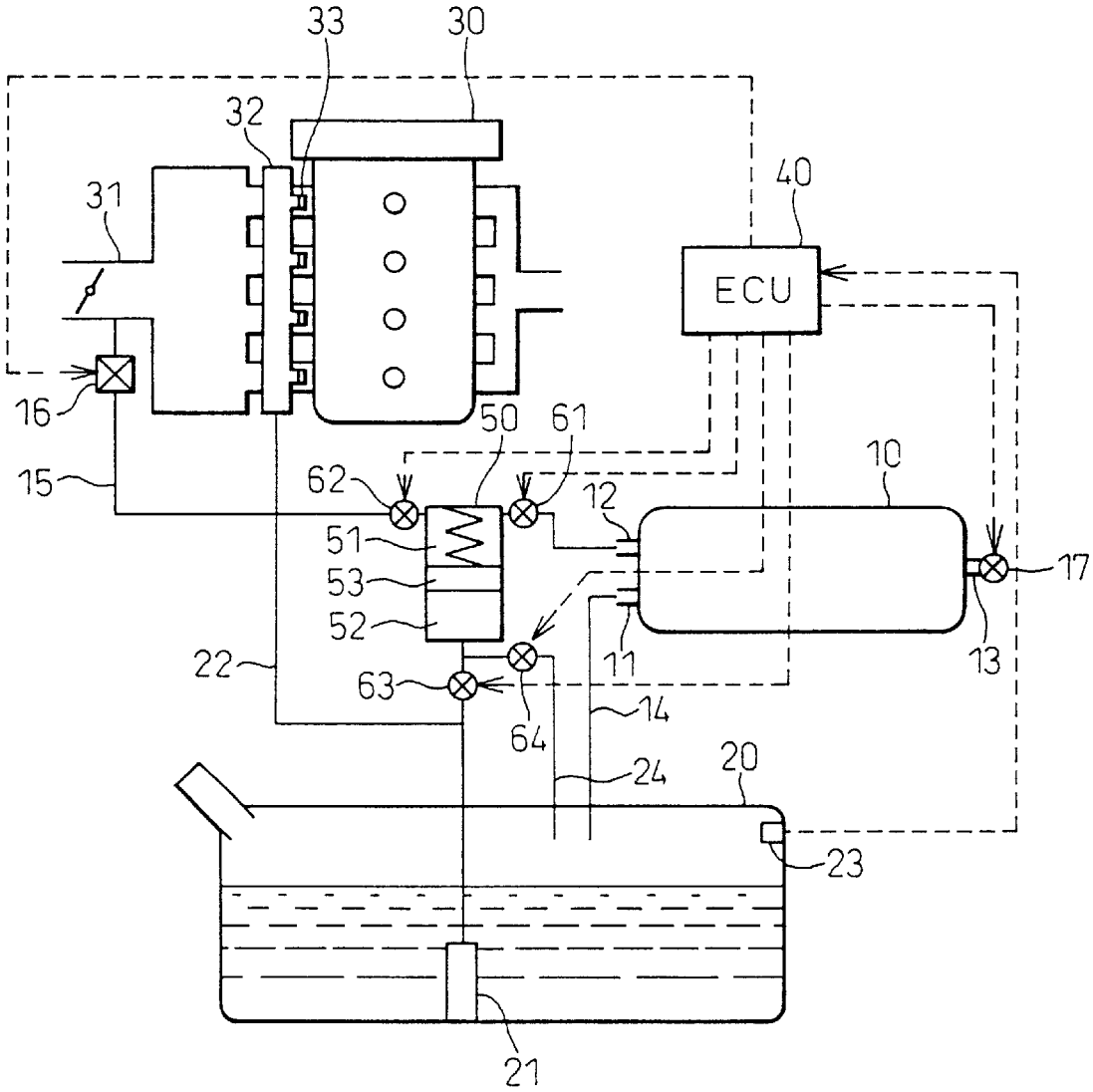
FIG. 18 is a schematic view showing a construction of an evaporated fuel processor of an internal combustion engine according to the seventh embodiment of the present invention.

FIG. 18 is a diagram showing the overall construction of the evaporated fuel processor according to the seventh embodiment. First, the construction of the evaporation system will be explained. An evaporation port 11 and a purge port 12 are formed at one of the ends of a canister 10 for adsorbing the evaporated fuel. An open-air port 13 is formed at the other end. Active carbon as the adsorbing material is packed into the canister 10 interposed between these ends. The evaporation port 11 of the canister 10 is connected to the fuel tank 20 through an evaporation passage 14. The purge port 11 is connected to an intake pipe 31 of an engine 30 through a purge passage 15. The evaporation passage 14 and the purge passage 15 together constitute an evaporated fuel passage. A purge valve 16 as a purge regulation valve for adjusting a purge flow rate and a purge pump 50 for compulsively conducting canister purge are provided to intermediate parts of the purge passage 15. An ECU 40 controls the operation of the purge valve 16. The construction and operation of the purge pump 50 will be explained later. The open-air port 13 of the canister 10 is open to the open air through a canister-closed valve 17.

Next, the construction of the fuel system will be explained. A fuel pump 21 for pressure-feeding the fuel is disposed inside the fuel tank 20. The fuel pump 21 is connected to a delivery pipe 32 of the engine 30 through a fuel pipe 22. The delivery pipe 32 is connected to a plurality of injectors 33 disposed for each cylinder, and the fuel stored in the delivery pipe 32 is jetted into each cylinder through the injectors 33. Incidentally, the ECU 40 controls the operations of the fuel tank 21 and the injectors 33. A pressure sensor 23 is disposed inside the fuel tank 20 to measure the internal pressure of the tank.

Figure 19:
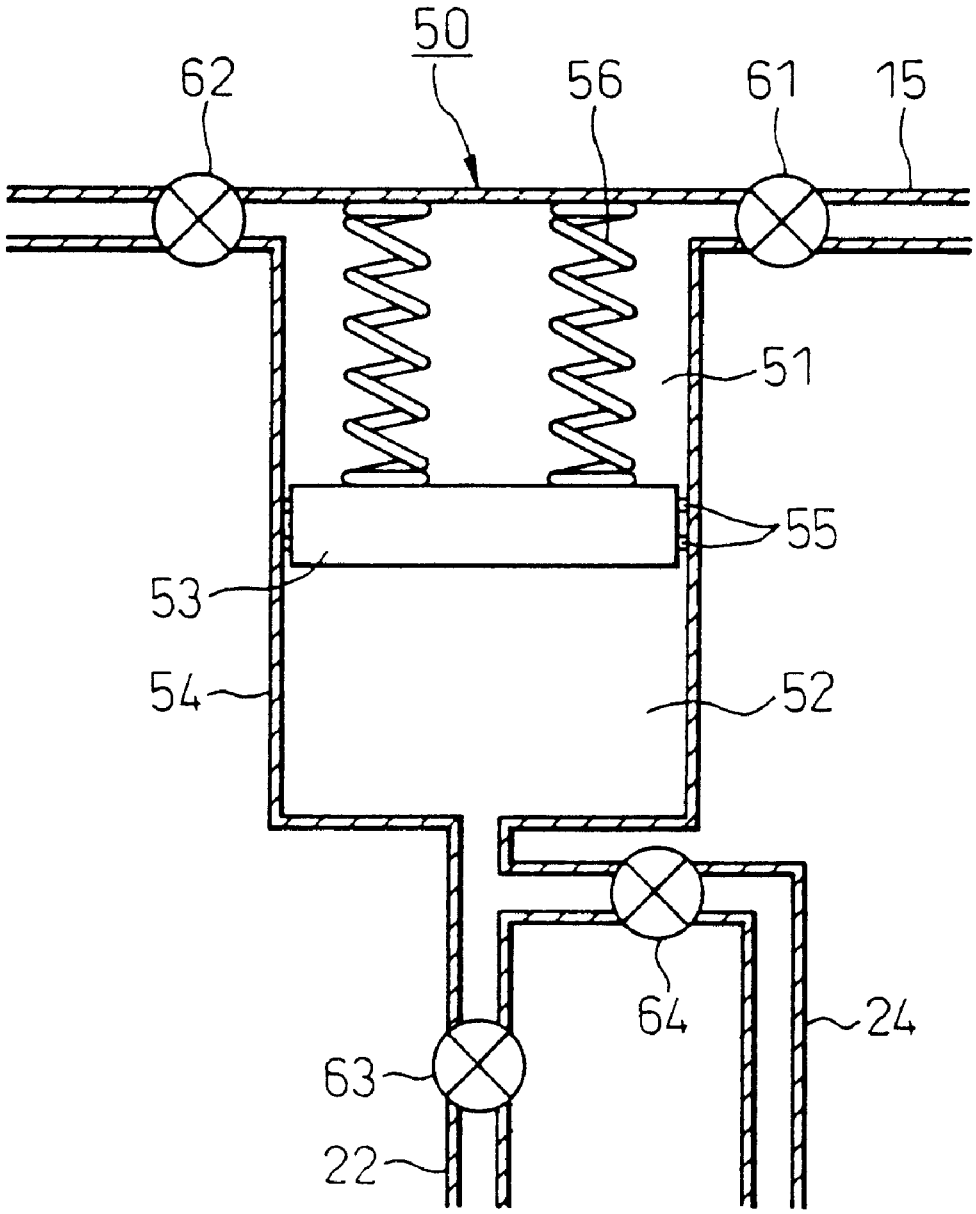
FIG. 19 is a sectional view showing a construction of a purge pump.

Next, the detailed construction of the purge pump 50 will be explained with reference also to FIG. 19. In FIG. 19, the purge pump 50 is shown divided into a first chamber 51 for introducing the purge gas as purge air and a second chamber 52 for introducing a pressurized fuel by the fuel pump 21. The first chamber 51 is disposed at an intermediate part of the purge passage between the canister 10 and the purge valve 16, and the second chamber 52 is disposed at an intermediate part of the fuel pipe 22 between the fuel pump 21 and the delivery pipe 32. The first and second chambers 51 and 52 are partitioned by a piston 53 as a movable member capable of reciprocating in a vertical direction of the drawing. A seal ring 55 seals the clearance between the piston 53 and a case 54 to prevent the leak of the purge gas inside the first chamber and the fuel inside the second chamber 52.

A spring 56 pushes downward the piston 53 in the drawing. The balance between the force of the spring 56 and the fuel pressure inside the second chamber 52 determines the position of the piston 53. Incidentally, the state shown in FIG. 19 is not the initial state but represents the state where the pressurized fuel has already been introduced into the second chamber 52 and the piston 53 has moved up in the drawing. In the explanation that follows, the state shown in FIG. 19 is used as the reference to determine the movement of the piston 53 in the vertical direction. In other words, the upward movement is called an "up movement" and the downward movement is called a "down movement".

The first chamber 51 is provided with two ports. One of the ports is connected to the canister 10 through the purge passage 15. A valve 61 is positioned at the junction with the purge passage 15. The other port of the first chamber 51 is connected to the purge valve 16 through the purge passage 15, and a valve 62 is positioned at the junction with the purge passage 15.

The second chamber 52 is provided with one port. A passage extending from this port is branched into two passages. One of them is connected to the fuel pipe 22, and a valve 63 is positioned at the junction. The other passage is connected to the fuel tank 20 through the return pipe 24, and a valve 64 is positioned at the junction with the return pipe 24. The ECU 40 independently controls opening/closing of these valves 61 to 64. Though two ports are formed in the first chamber 51 in FIG. 19, the first chamber 51 may have the construction wherein one port is branched in the same way as the second chamber 52. Though the second chamber 52 has the construction wherein one port is branched, it may have the construction wherein two ports are formed in the same way as the first chamber 51.

When the pressurized fuel is introduced by the fuel pump 21 into the second chamber 52 in the purge pump 50 described above, the piston 53 moves up due to the fuel pressure as shown in FIG. 19, and the capacity of the first chamber 51 becomes small. When the second chamber 52 is connected to the return side and the fuel pressure is released, the piston 53 moves down. When it reaches a predetermined position (the bottom surface of the case 54, for example), the capacity of the first chamber 51 becomes maximal.

Figure 20:
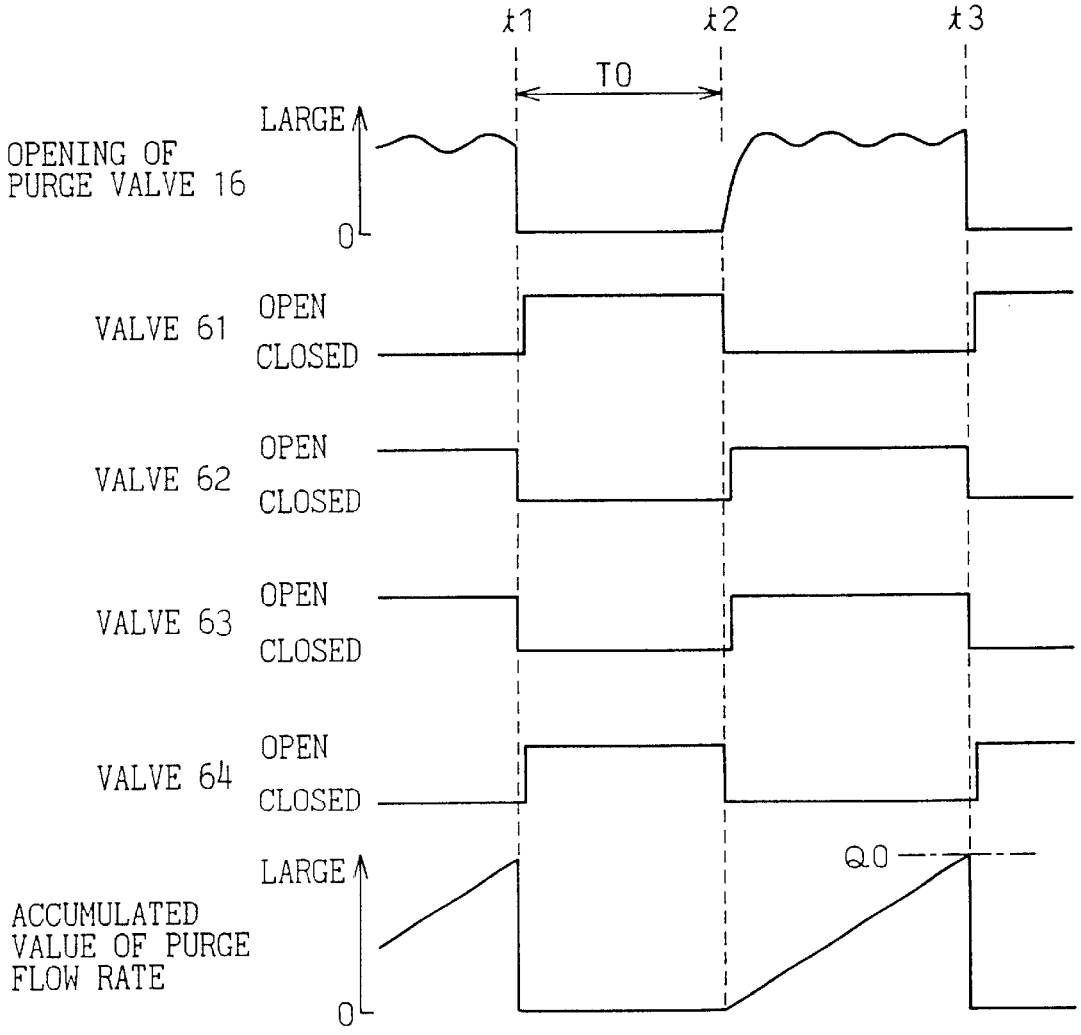
FIG. 20 is a time chart showing the outline of a purge control operation.

The summary of the operation of the evaporated fuel processor having the construction described above will be explained with reference to the time chart of FIG. 20. Referring to FIG. 20, timings of t1 and t3 represent the timings at which the purge valve 16 is closed and the purge from the canister 10 to the engine intake system is stopped, respectively. Timing t2 is the timing at which the purge valve 16 is opened and the purge from the canister 10 to the engine intake system is started.

While the purge is stopped at the timings t1 to t2 (while the purge valve 16 is closed), the purge gas is introduced into the first chamber 51 of the purge pump 50. In other words, the valve 63 is closed with the valve 64 being open at the timing t1 to release the fuel pressure of the second chamber 52. At the same time, the valve 62 is closed with the valve 61 being open to thereby communicate the first chamber 51 with the canister 10. In this instance, the canister closed valve 17 on the open-air side of the canister 10 is left open. Strictly speaking, however, the possibility of the instantaneous backflow exists due to the difference of the response speeds of the individual valves when the above four valves are opened simultaneously. Therefore, time lags are secured so that the valves to be closed are closed first and then the valves to be opened are opened as shown in the drawing.

When the fuel pressure of the second chamber 52 is released, the force of the spring 56 pushes the piston 53 down to the bottom surface of the case 54. Therefore, the capacity of the second chamber 52 becomes minimal, and the fuel inside the second chamber 52 is discharged to the fuel tank 20 through the valve 64 and through the return pipe 24. The capacity of the first chamber 51 increases, on the contrary, and the pressure is reduced. In consequence, air is sucked from the canister closed valve 17 into the canister 10, and the purge gas purging the canister 10 flows into the first chamber 51. Since the clearance between the piton 53 and the case 54 is sealed by the seal ring 55 at this time, the purge gas does not flow into the second chamber 52. While the purge gas is introduced into the first chamber 51 in this way, the valve 63 is left closed. Therefore, the line from the fuel pump 21 to the fuel pipe 22 and to the delivery pipe 32 is closed, and the fuel pressure generated in the fuel pump 21 does not leak.

After the purge gas is sufficiently sucked into the first chamber 51, the valve 64 is closed while the valve 63 is opened with the start of purging at the timing t2, so that the pressurized fuel is introduced into the second chamber 52. At the same time, the valve 61 is closed and the valve 62 is opened, and the first chamber 51 is communicated with the purge valve 16. (In this case, too, the time lag exists between opening and closing of the valves). Thereafter, opening of the purge valve 16 is controlled in accordance with the operating condition of the engine, etc. Here, the fuel pressure by the fuel pump 21 is generally from several hundreds of kPa to several MPa, and is incomparably higher than the pressure loss of several kPa in the purge passage 15. Therefore, the fuel pushes up the piston 53. As a result, the purge gas in the first chamber 51 is moved into the intake pipe 31 while the purge valve 16 controls its flow rate. As the seal ring 55 seals the clearance between the piston 53 and the case 54 at this time, the fuel does not flow into the first chamber 51. While the fuel is introduced in this way into the second chamber 52, the valve 64 remains closed. Therefore, the fuel pressure of the delivery pipe 32 hardly changes if the maximum capacity of the second chamber 52 (the capacity at the uppermost point of the piston 53) and the capacity from the fuel pump 21 to the fuel pipe 22 and to the delivery pipe 32 are set to appropriate values.

The time T0 required for sufficiently sucking the purge gas into the first chamber 51 is determined by the force of the spring 56, the capacity change amount of the first chamber 51, the pressure loss of the canister 10 and the pressure loss in the evaporated fuel passage between the canister 10 and the purge pump 50, and can be determined in advance. During the purge stop period, the valve 64 is closed and the valve 63 is opened after the passage of this time T0, so that the pressurized fuel is introduced into the second chamber 52 and at the same time, the valve 61 is closed and the valve 62 is opened, thereby starting the purging operation.

The purge gas quantity Q0 which the purge pump 50 can deliver at a time in purging, is the difference between the capacity of the first chamber 51 at the lowermost point of the piston 53 and the capacity of the first chamber 51 at the uppermost point. It is possible in this case to judge whether or not one purging operation is sufficiently completed, that is, whether or not the piston 53 reaches the uppermost point, by determining the accumulated value Q of the purge flow rates from the opening degree of the purge valve 16 and by judging whether or not the accumulated value Q reaches the purge gas amount Q0. When the piston 53 reaches the uppermost point, purging is stopped at that point. In other words, the valve 63 is closed while the valve 64 is opened. The fuel pressure of the second chamber 52 is released and at the same time, the valve 62 is closed and the valve 61 is opened with the result that the purge gas is introduced into the first chamber 51.

Next, the purge control routine using the purge pump 50 described above will be explained with reference to the flowchart in FIG. 21. The routine shown in FIG. 21 corresponds to "control means" described in the Scope of claim for Patent, and the ECU 40 executes this routine. In this control, the purge gas is first discharged from the purge pump 50 into the engine intake pipe 31 and then the purge gas is introduced into the purge pump 50. In other words, the purge gas is introduced in advance into the first chamber 51 of the purge pump 50 at the start of this routine.

Figure 21:
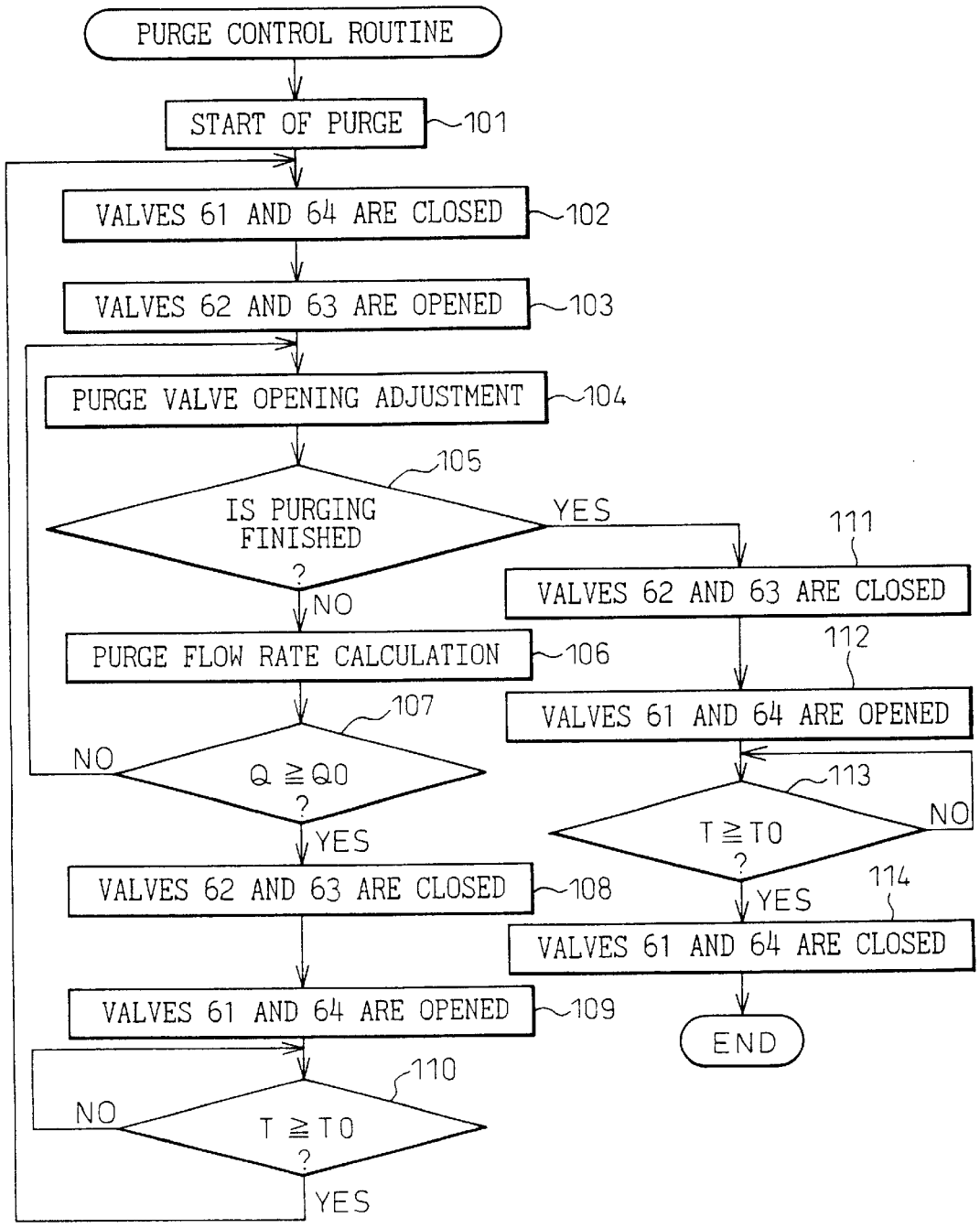
FIG. 21 is a flowchart showing a purge control routine.

In the first step 101 in FIG. 21, the start of the purge control is judged on the basis of the known purge execution condition comprising the engine operating condition, etc, and the subsequent routine is thereafter executed. In the step 102, the valve 61 and the valve 64 are closed. In the subsequent step 103, the valve 62 and the valve 63 are opened. As a result of the steps 102 and 103, the first chamber 51 of the purge pump 50 is communicated with the engine intake pipe 31 and the second chamber 52 of the purge pump 50 is communicated with the fuel pump 21 (at the timing t2 in FIG. 20).

In the step 104, opening of the purge valve 16 is adjusted on the basis of signals of an $O_2$ sensor (or an A/F sensor) disposed in the exhaust pipe or the engine operating condition. In the step 105, whether or not the purging control is to be continued is judged on the basis of the known purge execution condition in the same way as described above. When the purge control is to be continued, the flow proceeds to the step 106 and when the purge control is stopped, the flow proceeds to the step 111.

When the purge control is continued, the purge flow rate is determined from opening degree of the purge valve 16 in the step 106. In the next step 107, whether or not the accumulated value Q of the purge flow rate from the start of purging is greater than the purge gas amount Q0 of one purging operation is judged. Here, the purge gas amount Q0 of one purging operation corresponds to the difference of the capacity of the first chamber 51 at the lowermost point of the piston and its capacity at the uppermost point as described above.

When Q<Q0, the routine returns to the step 104 by judging that the purge gas still remains inside the first chamber 51 of the purge pump 50, and opening adjustment of the purge valve 16 is continued. When Q≧Q0, the routine proceeds to the step 108 by judging that the purge gas does not remain inside the first chamber 51. In the routine after the step 108, the purge valve 16 is once closed and the purge gas is introduced into the purge pump 50.

In other words, in the step 108, the valve 62 and the valve 63 are closed. In the subsequent step 109, the valve 61 and the valve 64 are opened. In consequence, the fuel pressure inside the second chamber 52 is released and the purge gas is sucked into the first chamber 51 (at the timings t1 and t3 in FIG. 20). In the step 110, whether or not the time passed from the start of sucking of the purge gas into the first chamber 51 reaches the required time T0 (whether or not T≧T0) is judged. When the result proves YES, the routine returns to the step 102 and purging is started again.

On the other hand, when the judgment is made in the step 105 to stop the purge control, the routine proceeds to the step 111 and the finish processing of the purge control is executed. In other words, in the step 111, the valve 62 and the valve 63 are closed. In the subsequent step 112, the valve 61 and the valve 64 are opened. Consequently, the fuel pressure of the second chamber 52 is released and the purge gas is sucked into the first chamber 51. In the subsequent step 113, the required time T0 is awaited for sufficiently sucking the purge gas into the first chamber 51 in the same way as in the step 110. In the step 114, the valve 61 and the valve 64 are closed. After all the ports of the purge pump 50 are closed, this routine is finished.

The finish processing of the steps 111 to 114 withdraws the fuel inside the second chamber 52 when the purge control is finished. Therefore, the high-pressure fuel is not allowed to remain in the second chamber 52 at the end of the purge control, and does not accidentally leak.

Further, the fault diagnosis of the evaporated fuel processor can be conducted by use of this purge pump 50. Hereinafter, the fault diagnosing routine executed by the ECU 40 will be explained with reference to the flowchart of FIG. 22. The processing shown in FIG. 22 is conducted at the start and stop of the engine, or is executed in a predetermined time cycle.

Figure 22:
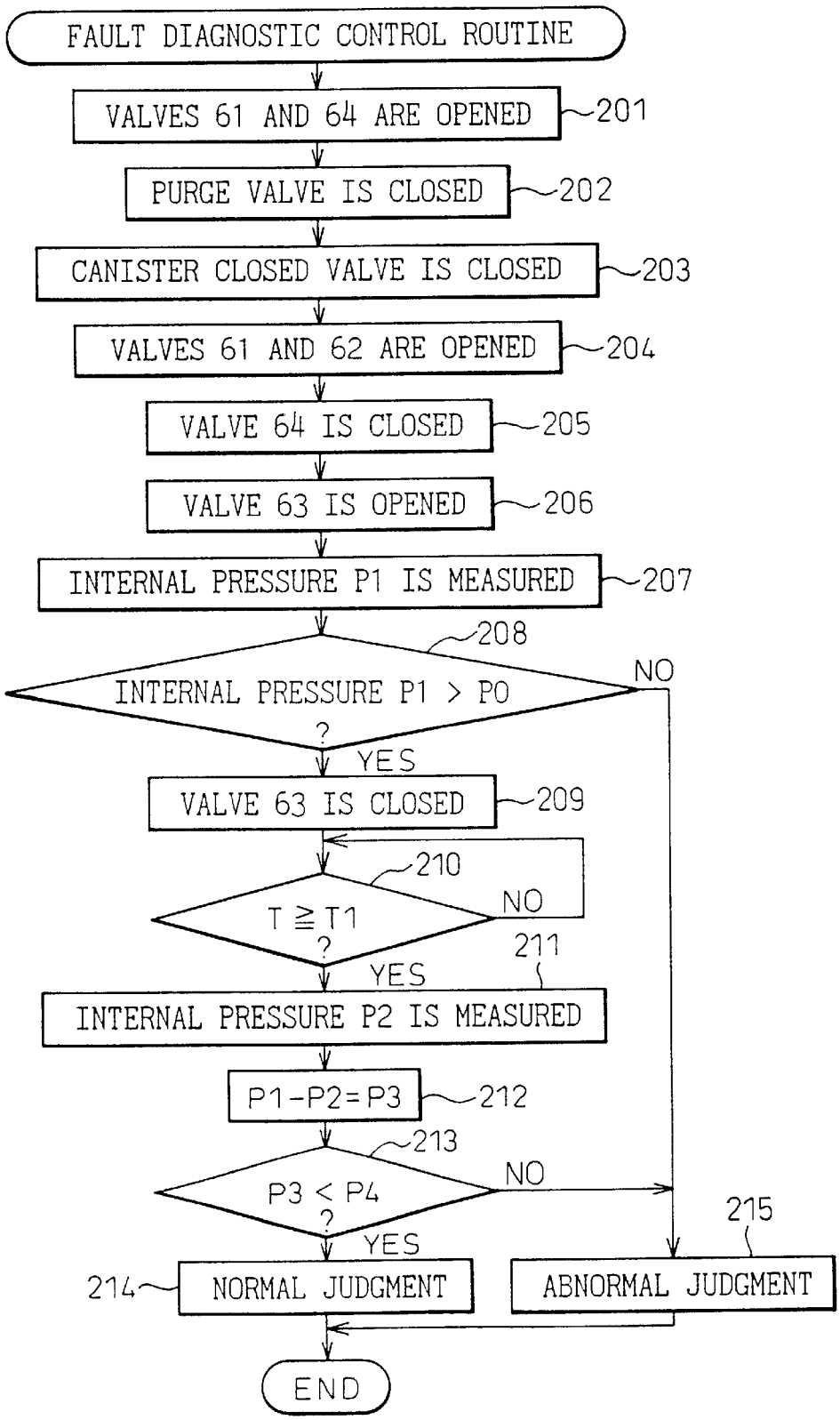
FIG. 22 is a flowchart showing a fault diagnosing routine of the evaporated fuel processor.

When the processing shown in FIG. 22 is started, the valves 61 and 64 are first opened (step 201) and the fuel pressure of the second chamber 52 is released. Next, the purge valve 16 is closed and the canister closed valve 17 is closed, too. Further, the valves 61 and 62 are opened (steps 202 to 204). Consequently, the "evaporated fuel space" comprising the space extending from the purge valve 16 to the purge pump 50 and to the canister 10 through the purge passage 15 and the space extending from the canister 10 to the fuel tank 20 through the evaporated fuel passage 20, becomes a closed space. While this closed space is defined, the valve 64 is closed whereas the valve 63 is opened (steps 205 and 206) to introduce the pressurized fuel into the second chamber 52 of the purge pump 50. Then, the fuel pressure pushes up the piston 53 inside the purge pump 50 and the closed space is pressurized.

In the step 207, a standby state is secured for a short time until the pressure change settles. The pressure sensor 23 then measures the pressure P1 of the closed space. In the subsequent step 208, whether or not the pressure P1 is greater than the predetermined pressure P0 is judged. Here, if no hole exists in the closed space (the evaporated fuel space), the pressure P1 is supposed to rise with the pressurizing operation of the purge pump 50 and to reach a predetermined value determined by the capacity change amount of the first chamber 51 of the purge pump 50 and the capacity of the closed space. In contrast, if any hole exists in the closed space (the evaporated fuel space), the pressure P1 hardly rises. The pressure P0 is decided in advance with the predetermined pressure value that should be originally reached, as the reference. Since the pressure elevation varies depending on the temperature factor and on the fuel remaining amount inside the tank, however, the pressure P0 is preferably determined in consideration of these factors.

When P1>PO, the routine proceeds to the subsequent step 209. When P1≦P0, the routine proceeds to the step 215 by judging that a hole exists in the closed space, and the occurrence of abnormality is judged.

When a relatively large hole exists in the closed space, the step 208 described above can easily confirm the existence of the hole. When a very small hole exists, however, the judgment of the step 208 cannot confirm the existence of the hole. Therefore, in the step 209, the existence/absence of the hole is judged on the basis of the pressure drop state of the closed space. In other words, in the step 209, the valve 63 is closed and the pressure of the second chamber 52 is held. In the step 210, the passage of the lapse of time T from the closure of the valve 63 is awaited for a predetermined time T1 (for example, one to two minutes). In the subsequent step 211, the pressure sensor 23 measures the pressure P2 of the closed space after the passage of the time T1.

Assuming that a very small hole exists in the closed space, the pressure P2 (the measurement value of the step 211) becomes smaller than the pressure P1 (the measurement value of the step 207). Therefore, in the step 212, the difference [P1−P2] is calculated to obtain the pressure difference P3. In the next step 213, whether or not this pressure difference P3 is smaller than a stipulated pressure P4 at the maximum leak permitted to the present system, is judged. If P3<P4, the routine proceeds to the step 214 by regarding that a hole exceeding the allowable size does not exist, and the normal judgment is given. If P3≧P4, the routine proceeds to the step 215 by regarding that a hole exceeding the allowable size exists, and the occurrence of abnormality is judged.

Incidentally, the pressure difference P3 of the step 212 is the parameter representing the pressure drop state, and when this pressure difference P3 is known, not only the existence/absence of the leak but also the degree of the leak (the size of the hole) can be known.

The fault judgment described above can obtain the same result not only in the evaporated fuel passage but also when any leak exists in the first and second chambers 51 and 52 of the purge pump 50. Therefore, it functions also as the fault judgment of the purge pump itself.

As described above in detail, the seventh embodiment provides the following effects.

Since this embodiment uses the purge pump 50 driven by the fuel pressure, it does not invite an adverse influence on the fuel system, such as a fluctuation of the fuel pressure, unlike the conventional purge pumps that utilize the flow of the fuel. Since the fuel pressure (by the fuel pump 21) as the driving source of the purge pump 50 can be kept substantially constant irrespective of the engine operating condition, the purge pump 50 can be driven always stably. As a result, the evaporated fuel processor of the seventh embodiment can restrict the influence on the fuel system and can always exhibit the stable purge capacity irrespective of the engine operating condition.

Particularly in the apparatus of the seventh embodiment, the operation of the purge pump 50 compulsively purges the evaporated fuel inside the canister 10. Therefore, it is possible to accomplish an apparatus suitable for a direct injection engine or a lean-burn engine in which the negative pressure of the intake pipe becomes smaller when the air-fuel ratio becomes leaner.

Since the piston 53 divides the purge pump 50 into the first and second chambers 51 and 52 under the sealed state, the leak of the pressurized fuel by the fuel pump 21 can be kept to a minimum. In consequence, the influences on the fuel injection can be minimized.

On the other hand, the "evaporated fuel space" from the purge valve 16 to the fuel tank 20 is the closed space, and the leak of the closed space is judged on the basis of the pressure change under this state at the time of pressurization by the purge pump and on the basis of the pressure drop condition after pressurization is complete. Therefore, the fault judgment can be conducted easily and appropriately. The fault judgment of the purge pump 50 can be also conducted conjointly.

Embodiment 8

Next, the eighth embodiment of the present invention will be explained with primary reference to its difference from the seventh embodiment.

Figure 23:
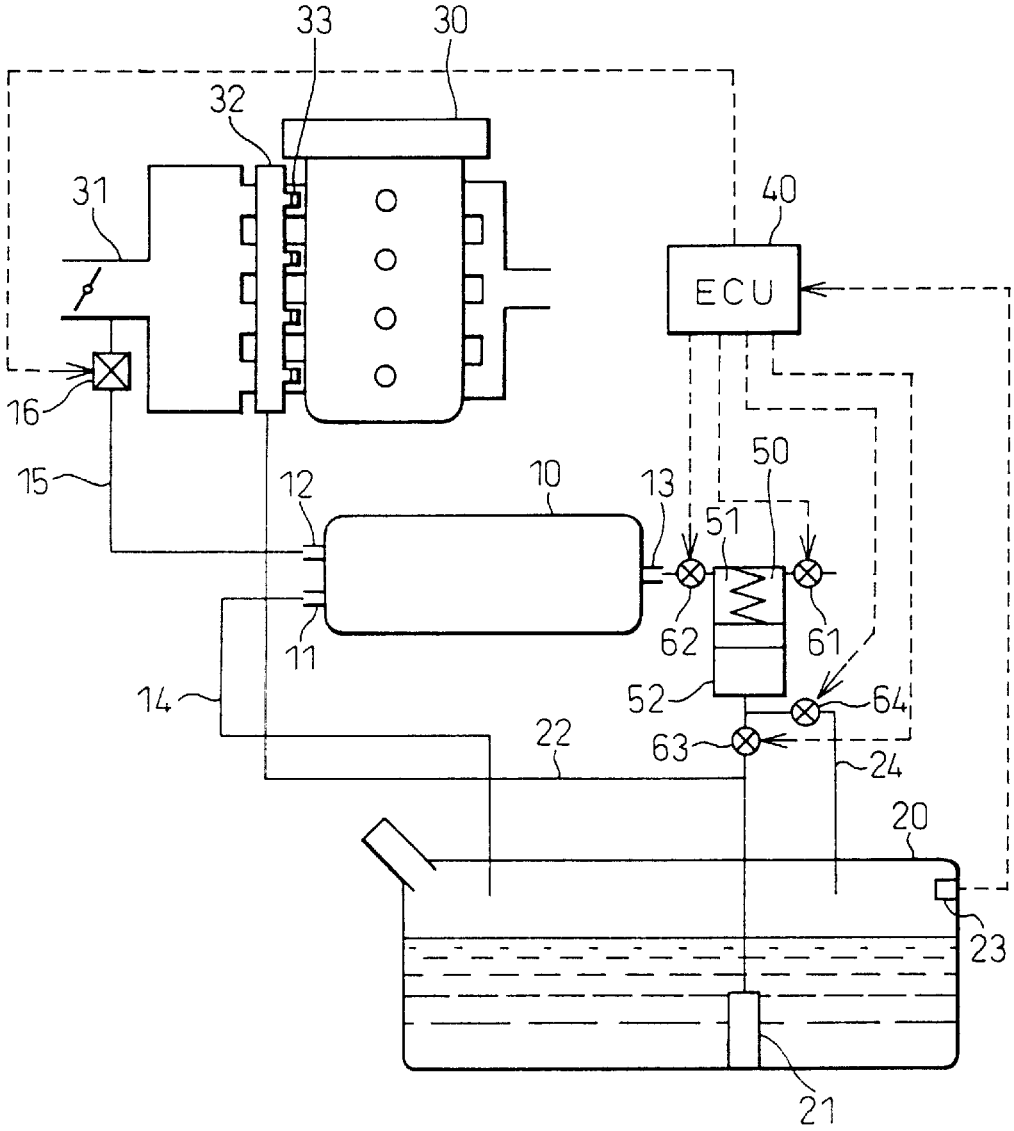
FIG. 23 is a schematic view showing a construction of an evaporated fuel processor of an internal combustion engine according to the eighth embodiment of the present invention.

FIG. 23 is a structural view showing the outline of an evaporated fuel processor according to the eighth embodiment. The difference from FIG. 18 is that the purge pump 50 is arranged at the open-air release portion of the canister 10. The purge pump 50 has the same construction as the one shown in FIG. 19. In this embodiment, the first chamber 51 of the purge pump 50 is connected to the open-air port 13 of the canister 10 through the valve 62, and is open to the open air through the valve 61. With this construction, the canister closed valve 17 is omitted. The second chamber 52 of the purge pump 50 is connected to the fuel pipe 22 through the valve 63 in the same way as described above, and is connected to the return pipe 24 through the valve 64.

Next, the outline of the operation of the evaporated fuel processor according to the eighth embodiment will be explained. Here, the operations of various valves are the same as those in the seventh embodiment, and the explanation will be given with reference to the time chart of FIG. 20.

While the purge is stopped at the timings t1 to t2 (while the purge valve 16 is closed), the air is introduced into the first chamber 51 of the purge pump 50. In other words, the valve 63 is closed with the valve 64 being open at the timing t1 to release the fuel pressure of the second chamber 52. At the same time, the valve 62 is closed with the valve 61 being open to thereby communicate the first chamber 51 with the open air. When the fuel pressure of the second chamber 52 is released, the spring 56 pushes down the piston 53 to the bottom surface of the case 54. Therefore, the capacity of the second chamber 52 becomes minimal, and the fuel inside this second chamber 52 is discharged to the fuel tank 20 through the valve 64 and the return pipe 24. The capacity increases in the first chamber 51, on the contrary, and the pressure is reduced. In consequence, the open air is sucked into the first chamber 51. Since the clearance between the piston 53 and the case 54 is sealed by the seal ring 55 at this time, the open air does not flow into the second chamber 52. While the open air is introduced into the first chamber 51 in this way, the valve 63 is left closed. Therefore, the line from the fuel pump 21 to the fuel pipe 22 and to the delivery pipe 32 is closed, and the fuel pressure generated in the fuel pump 21 does not leak.

After the air is sufficiently sucked into the first chamber 51, the valve 64 is closed while the valve 63 is opened with the start of purging at the timing t2, so that the pressurized fuel is introduced into the second chamber 52. At the same time, the valve 61 is closed and the valve 62 is opened, and the first chamber 51 is communicated with the open-air port 13 of the canister 13. Here, the fuel pressure by the fuel pump 21 is generally from several hundreds of kPa to several MPa, and is much higher than the pressure loss of several kPa in the canister 10 and in the purge passage 15. Therefore, the fuel pushes up the piston 53. As a result, the open air in the first chamber 51 flows into the canister 10, so that the canister 10 is purged.

Further, the purge gas that has purged the canister flows into the intake pipe 31 while its flow rate is controlled by the purge valve 16. Since the seal ring 55 seals the clearance between the piston 53 and the case 54 at this time, the fuel does not flow into the first chamber 51. While the fuel is introduced in this way into the second chamber 52, the valve 64 remains closed. Therefore, the fuel pressure of the delivery pipe 32 hardly changes if the maximum capacity of the second chamber 52 (the capacity at the uppermost point of the piston 53) and the capacity from the fuel pump 21 to the fuel pipe 22 and to the delivery pipe 32 are set to appropriate values.

In the eighth embodiment, too, the fault diagnosis can be made in the same way as in FIG. 22. The routine of the fault diagnostic processing by the ECU 40 will be explained briefly. To conduct the fault diagnosis, the ECU 40 opens the valves 61 and 64 to release once the purge pump 50, and then closes the purge valve 16 and the valve 61 to convert the "evaporated fuel space" from the purge valve 16 to the fuel tank 20 to the closed space. Thereafter, the ECU 40 closes the valve 64 but opens the valve 63, introduces the fuel into the second chamber 52 of the purge pump 50 and moves up the piston 53. In consequence, the pressure of the closed space rises, and the existence/absence of the leaking hole is judged in accordance with the pressure P1 of the closed space at this time. In this case, if the pressure P1 does not reach the predetermined pressure P0, the ECU 40 judges that an abnormality has occurred (the leaking hole exists).

When the pressure P1 rises up to the predetermined pressure P0, the existence/absence of the leaking hole is again judged in accordance with the pressure drop condition after pressurization is complete. In other words, the valve 63 is closed and the pressure of the second chamber 52 is held. When the pressure change (P3=P1−P2) from closing of the valve 63 to the passage of the time T1 is higher than a predetermined value P4, the occurrence of abnormality is judged. In this case, the fault judgment of the purge pump itself is simultaneously executed as described already.

Modified Embodiment of Embodiments 7 & 8

In Embodiments 7 and 8 described above, the purge pump 50 pressurizes the closed space and the pressure change under that state is monitored, but this construction can be changed in the following way. In other words, the purge pump 50 reduces the pressure of the closed space and under this state, the pressure change is monitored to conduct the fault diagnosis. The routine of the fault diagnostic processing by the ECU 40 will be briefly explained when the construction of FIG. 18 is applied.

To conduct the fault diagnosis, the ECU 40 first closes the valve 64 but opens the valve 63 to introduce the fuel pressure into the second chamber 52. The ECU 40 then closes the purge valve 16 and the canister closed valve 17 under this condition and converts the "evaporated fuel space" from the purge valve 16 to the fuel tank 20 to the closed space (both valves 61 and 62 are left opened). Thereafter, the ECU 40 closes the valve 63 but opens the valve 64 to release the fuel pressure of the second chamber 52. Consequently, the force of the spring 56 moves down the piston 53 and the pressure of the evaporated fuel space (the closed space) drops. The pressure of the closed space at this time is measured, and the existence/absence of the leaking hole is judged in accordance with this pressure. When the pressure of the closed space does not drop to a predetermined judgment value in this case, the occurrence of abnormality (the leaking hole exists) is judged.

When the pressure of the closed space falls to the judgment value, the existence/absence of the leaking hole is again judged in accordance with the pressure elevation condition after pressure reduction is complete. A predetermined time (for one to two minutes, for example) elapses after closing of the valve 64. When the pressure change is higher than the predetermined value at this time, the occurrence of abnormality is judged. In this case, too, the fault judgment of the purge pump itself is simultaneously conducted as already described. Needless to say, the fault diagnosis by the pressure reducing operation of the purge pump 50 can be employed when the construction of FIG. 23 is applied.

In this modified embodiment, too, the fault diagnosis can be executed easily and appropriately from the pressure change of the closed space. Particularly, because the fault diagnosis is executed by reducing the pressure of the closed space by use of the purge pump 50, the open air is sucked through a hole, if any leaking hole exists in each passage. Therefore, the disadvantage that the evaporated fuel is discharged from the leaking hole to the open air, during the fault diagnosis, can be avoided.

In addition, the present invention can also be embodied in the following way.

In the seventh and eighth embodiments, the piston 53 partitions the purge pump 50 into the first and second chambers 51 and 52. However, this construction can be changed. For example, a diaphragm or bellows are used as the movable member to partition the first and second chambers 51 and 52. In this case, the capacity of each chamber 51, 52 varies in accordance with deformation of the diaphragm or the bellows. In this construction, in particular, the first and second chambers 51 and 52 are completely cut off, and the leak between both chambers (mixture of the purge gas into the fuel system and mixture of the fuel into the evaporation purge system) can be reliably prevented. In short, an arbitrary member can be employed as the movable member so long as it can partition the first and second chambers 51 and 52 under the sealed condition and can reciprocate in accordance with the fuel pressure inside the second chamber 52 to thereby vary the capacity of the first chamber 51.

Figure 24:
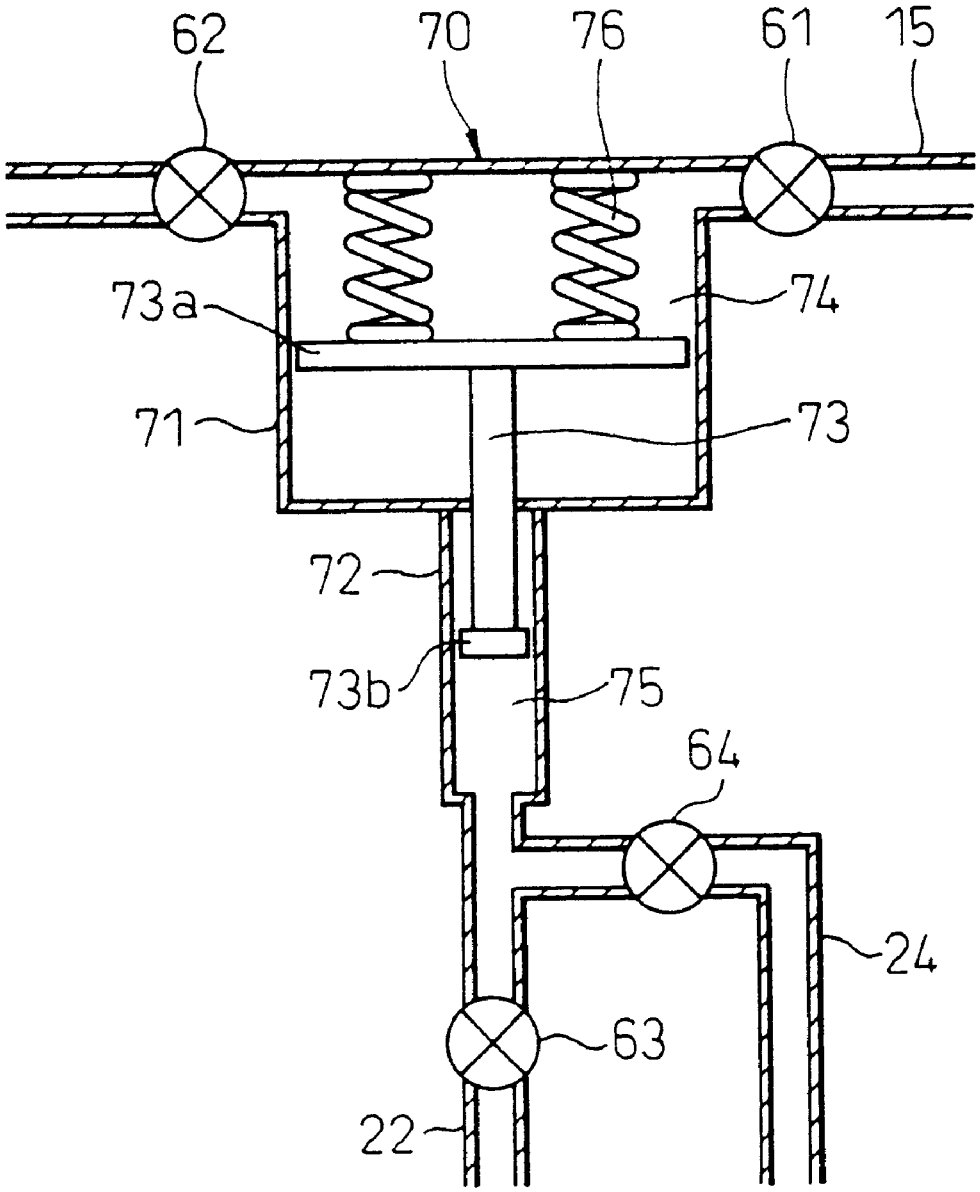
FIG. 24 is a sectional view showing another construction of the purge pump.

In the seventh and eighth embodiments, the first chamber 51 and the second chamber 52 of the purge pump 50 are arranged inside the same case 54. Therefore, when the piston 53 reciprocates, the capacity of each chamber remains the same. However, this construction can be modified as shown in FIG. 24. The purge pump 70 shown in FIG. 24 is provided with a first case 71 and a second case 72 each having a different cylinder diameter. A piston 73 as a reciprocating member slides and reciprocates inside each case 71, 72. In the first case 71, a first chamber 74 partitioned by a slide portion 73*a* of the piston 73 is formed. In the second case 72, a second chamber 75 partitioned by a slide portion 73*b* of the piston 73 is formed similarly. A spring 76 is disposed in the first chamber 74. Valves 61 to 64 are provided to each port in the same way as in the construction shown in FIG. 19.

In the purge pump 70 having the construction described above, the capacity change of the second chamber 75 during driving is smaller than the capacity change of the first chamber 74. Therefore, the change (the drop) of the fuel pressure during the introduction of the fuel pressure into the second chamber 75 is kept to a minimum. In other words, the influences on the fuel system (the pressure drop of the delivery pipe, etc) during the pump operation can be reduced, and the construction becomes a more preferable construction.

To execute the fault diagnosis of the evaporated fuel processor, the seventh and eighth embodiments execute both the processing (the step 208 in FIG. 22) for judging the leak of the closed space depending on whether or not the pressure inside the closed space rises to the predetermined value with the pressurizing operation of the purge pump, and the processing (the step 213 in FIG. 22) for judging the leak of the closed space from the pressure drop condition of the closed space after the passage of the predetermined time after the purge pump finishes pressurizing the closed space. However, the fault diagnostic processing may be accomplished by executing either one of them. This also holds true of the fault diagnosis by means of the pressure reduction of the purge pump.

When executing the fault diagnosis of the evaporated fuel processor, the seventh and eighth embodiments execute the abnormality judgment by pressurizing or evacuating the closed space and judging to which level the pressure rises or drops (the step 208 in FIG. 22), but this processing may be changed. During the pressurizing or evacuating operation by the purge pump, for example, the abnormality judgment is executed from the required time until the predetermined pressure is reached. In this case, when the predetermined time until the predetermined pressure is reached is longer than the reference time, the occurrence of an abnormality (the existence of a leaking hole) is diagnosed.

Embodiment 9

Figure 25:
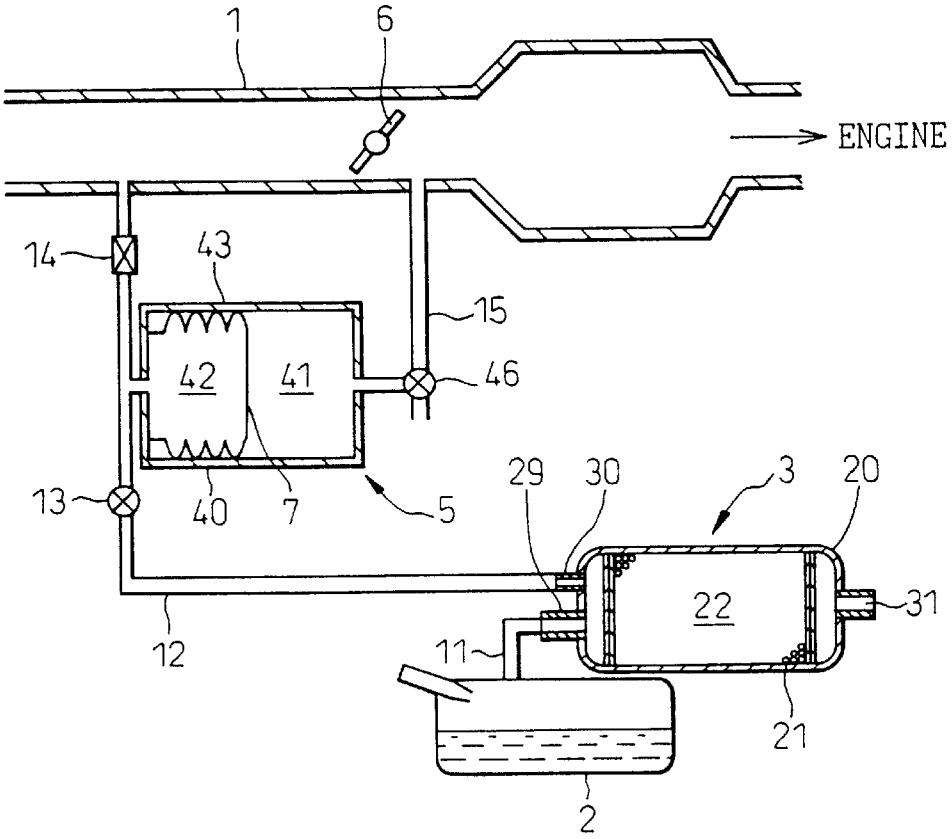
FIG. 25 is a schematic view showing a schematic construction of the evaporated fuel processor according to the ninth embodiment of the present invention.
Figure 26:
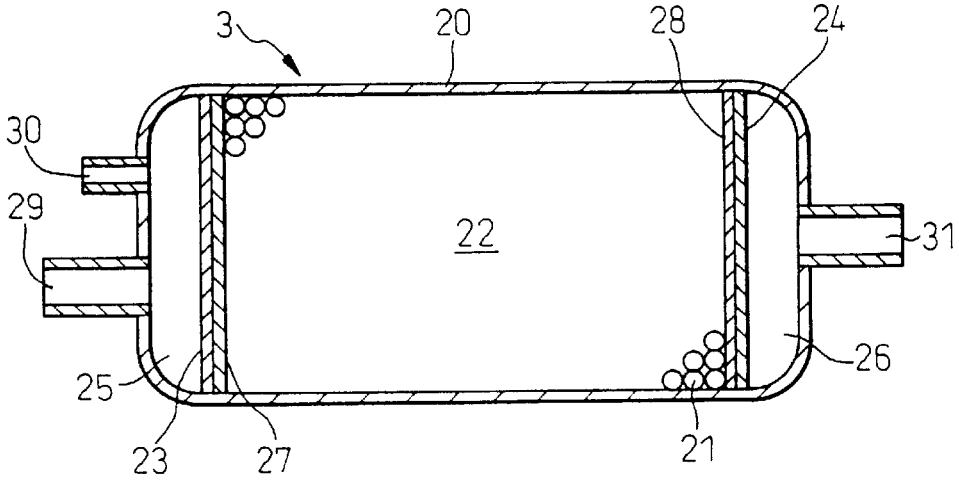
FIG. 26 is a schematic view showing a schematic construction of a canister according to the ninth embodiment.
Figure 27:
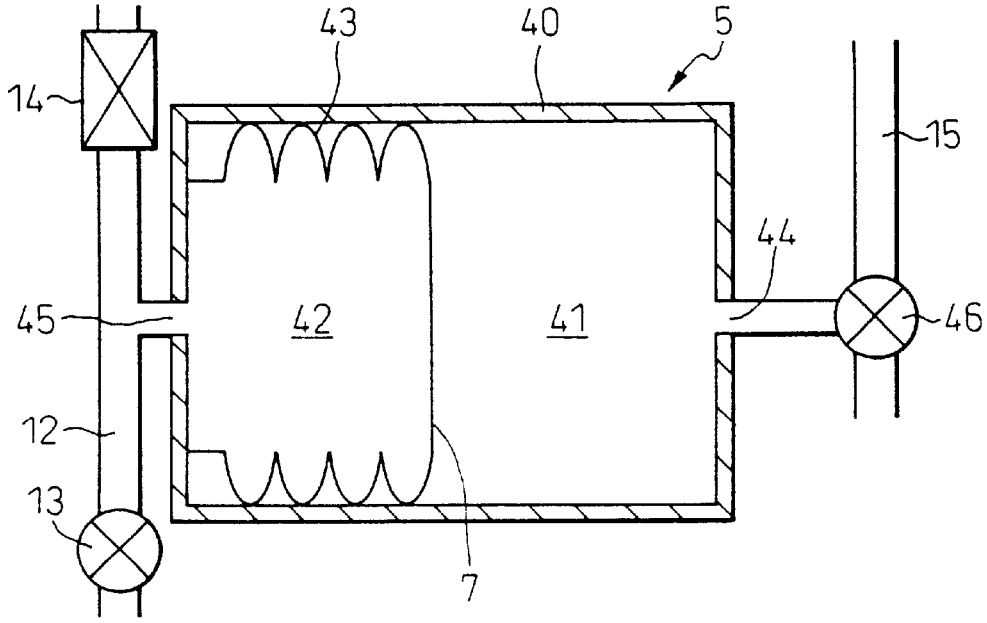
FIG. 27 is a schematic view showing a schematic construction of a purge pump according to the ninth embodiment.

FIGS. 25 to 27 show the ninth embodiment of the present invention. FIG. 25 shows a schematic construction of the evaporated fuel processor.

The evaporated fuel processor according to the ninth embodiment compulsively desorbs the evaporated fuel adsorbed by a fuel-adsorbing layer 22 inside a canister 3 therefrom by utilizing an intake negative pressure occurring in an intake pipe of a low intake pipe negative pressure engine such as a direct injection type engine mounted to a car (hereinafter called merely the "engine"), and delivers the evaporated fuel evaporating inside a fuel tank 2 into the intake pipe 1. The evaporated fuel processor includes an evaporated fuel passage 11 extending to the fuel tank 2, a purge passage 12 extending to the intake pipe 1 of the engine, the canister 3 for temporarily adsorbing and holding the evaporated fuel emitted from the fuel tank 2 to the evaporated fuel passage 11, a purge pump 5 for desorbing compulsively the evaporated fuel adsorbed by the fuel-adsorbing layer 22 formed inside the canister 3, and purge pump driving means (to be described later) for driving the purge pump 5 by utilizing the intake pipe negative pressure occurring in the intake pipe 1 when a throttle valve 6 of the engine is opened or closed.

The fuel tank 2 is connected to the canister 3 through the evaporated fuel passage 11. The purge passage 12 connects the canister 3 to the upstream side of the throttle valve 6 of the intake pipe 1 of the engine, and also connects it to a second chamber 52 of the purge pump 5 at an intermediate part of the purge passage 12. A valve 13 is interposed between the canister 3 of the purge passage 12 and the purge pump 5, and a purge valve 14 for controlling a purge flow rate is interposed between purge pump 5 and the intake pipe 1. A negative pressure introduction passage 15 connects a first chamber 41 of the purge pump 5 to the downstream side of the throttle valve 6 of the intake pipe 1 of the engine.

Next, the construction of the canister 3 of the ninth embodiment will be explained briefly with reference to FIG. 26. Here, FIG. 26 shows a schematic construction of the canister 3.

A large number of active carbon particles are packed into a case 20, that constitutes an outer wall of the canister 3, and form a fuel-adsorbing layer 22. Porous plates 23 and 24 are provided to both ends of the fuel-adsorbing layer 22 in such a fashion as to interpose the fuel-adsorbing layer 22 between them. Air layers 25 and 26 are defined between the right and left ends of the case 20 in the drawing and the porous plates 23 and 24, respectively, so that the evaporated fuel or the open air can be uniformly distributed to the fuel-adsorbing layer 22. Filters 27 and 28 are interposed between the porous plates 23 and 24 and the fuel-adsorbing layer 22, respectively, to prevent fall-off of the active carbon 21. An evaporation port 29 and a purge port 30 are provided to one of the ends of the case 20. The evaporation port 29 is connected to the evaporated fuel passage 11, and the purge port 30 is connected to the purge passage 12. An open-air port 31 is provided to the other end of the case 20 and is connected to the open air.

The construction of the purge pump 5 in the ninth embodiment will be explained briefly with reference to FIG. 27. Here, FIG. 27 shows a schematic construction of the purge pump 5.

A first chamber (driving chamber) 41 for introducing the intake pipe negative pressure and a second chamber (pump chamber) 42 for sucking and delivering the purge air are disposed inside a case 40 that constitutes the outer wall of the purge pump 5. A partition 7 that is biased to the right in the drawing by urging means such as a return spring, not shown, is interposed between the first chamber 41 and the second chamber 42. The partition 7 hermetically seals the first and second chambers 41 and 42 lest an air leak occurs between these chambers 41 and 42.

The partition 7 is connected to bellows 43 and is so constituted as to be capable of freely changing the capacities of the first and second chambers 41 and 42. A communication port 44 for communicating the first chamber 41 with a negative pressure introduction passage 15 is formed in the sidewall portion of the case 40 on the right side in the drawing. Another communication port 45 for communicating the second chamber 42 with an intermediate part of the purge passage 12 is formed in the sidewall portion of the case 40 on the left side in the drawing. Incidentally, the portion of the bellows 43 may use a thin film member or a extensible member such as a diaphragm because the partition 7 needs only to freely move in the transverse direction in the drawing. A three-way valve 46 corresponding to the purge pump driving means of the present invention is provided to an intermediate part of the negative pressure introduction passage 15.

The three-way valve 46 assumes a first switching state in which the first chamber 41 of the purge pump 5 is connected to the intake pipe side and the second switching state in which the first chamber 41 of the purge pump 5 is connected to the open air side. The three-way valve 46 constitutes first partition driving means that is switched to the first switching state when the throttle valve 6 of the engine is closed and a high intake pipe negative pressure is generated, introduces the intake pipe negative pressure into the first chamber 47, moves the partition 7 in the first direction in which the capacity proportion of the second chamber 42 is greater than that of the first chamber 41, purges the canister 3 and stores the purge air (evaporated fuel) inside the second chamber 42. The three-way valve 46 constitutes second partition driving means that is switched to a second switching state when the throttle valve 6 of the engine is opened and a low intake pipe negative pressure is generated, releases the intake pipe negative pressure from inside the first chamber 41 to the open air, moves the partition 7 in the second direction in which the capacity proportion of the second chamber 42 is smaller than that of the first chamber 41, and sends the purge air inside the second chamber 42 to the intake pipe 1 through the purge passage 12.

Next, the operation of the evaporated fuel processor according to the ninth embodiment will be briefly explained with reference to FIGS. 25 to 27.

When the engine is stopped, the valve 13 and the purge valve 14 are closed, and the three-way valve 46 is switched to the intake pipe 1 side. The evaporated fuel generated in the fuel tank 2 passes through the evaporated fuel passage 11, flows into the canister 3 and is adsorbed by a large number of active carbon particles 21 of the fuel-adsorbing layer 22. Since the three-way valve 46 is switched to the intake pipe 1 side, the evaporated fuel is prevented from leaking to the open air even when any hole is open in the partition 7 and in the bellows 43 and the evaporated fuel staying in the second chamber 42 diffuses into the first chamber 41.

When the throttle valve 6 is closed during the operation of the engine, the purge valve 14 is closed, the valve 13 is opened and the three-way valve 46 is switched to the intake pipe 1 side. In the low negative intake pressure engine such as the direct injection type engine, too, a high negative intake pressure is generated on the downstream side of the throttle valve 6 when the throttle valve 6 is closed during deceleration. This negative intake pressure is introduced into the first chamber 41 of the purge pump 5 from the negative pressure introduction passage 15. When it is introduced into the first chamber 41, the partition 7 is moved to the right in FIG. 27, that is, in the direction in which the capacity of the first chamber 41 becomes small (the first direction), and the capacity of the second chamber 42 becomes greater than that of the first chamber 41.

When the capacity of the second chamber 42 is thus expanded, a negative pressure develops in the second chamber 42. Since the purge valve 14 is closed and the valve 13 is opened at this time, air is sucked from the canister side. In other words, the open air flows from the open-air port 31 of the canister 3 into the canister 3. At this time, the evaporated fuel adsorbed by a large number of active carbon particles 21 of the fuel-adsorbing layer 22 is desorbed, and an air-fuel mixture (purge air) of the evaporated fuel and the open air passes through the purge passage 12 and flows into the second chamber 42 of the purge pump 5.

When the throttle valve 6 of the engine opens, the valve 13 is closed, the purge valve 14 is opened and the three-way valve 46 is switched to the open-air side, thereby releasing the negative intake pressure inside the first chamber 41. When the first chamber 41 is released to the open air, the partition 7 is moved to the left by the force of the bellows 43 and a spring, and the purge air inside the second chamber 42 is pushed out into the intake pipe 1 through the purge passage 12 while being adjusted by the purge valve 14, and is then burnt in the engine.

Further, when the throttle valve 6 of the engine is closed, the injection amount of the fuel injected and supplied from the injector into the combustion chamber of the engine is small. Therefore, the evaporated fuel purged exerts a great influence on the air-fuel ratio when it flows into the engine. When the throttle valve 6 is opened, on the other hand, the fuel injection amount is great, so that the influence of the purged and evaporated fuel on the air-fuel ratio is small. In view of these factors, the ninth embodiment does not deliver the purge air into the engine through the intake pipe 1 when the throttle valve 6 exerting the great influences on the air-fuel ratio is closed, but stores it inside the second chamber 42. Instead, this embodiment delivers the purge air into the engine when the throttle valve 6 is opened where the influence on the air-fuel ratio is small.

As described above, in the evaporated fuel processor according to the ninth embodiment, the negative intake pressure is introduced into the first chamber 41, when the throttle valve 6 is closed and the high negative intake pressure is generated, to move the partition 7 to the right (in the first direction) in the drawing. The movement of the partition 7 purges the canister 3, and the evaporated fuel (purge air) is sucked into the second chamber 42. When the throttle valve 6 is thereafter opened and the negative intake pressure becomes low, the negative intake pressure is released, and the partition 7 is moved to the left (in the second direction) in the drawing by use of the spring, etc, so that the evaporated fuel inside the second chamber 42 is emitted into the intake pipe 1.

In this way, the ninth embodiment makes the most of the negative intake pressure generated in the intake pipe 1 when the throttle valve 6 is closed, and drives the purge pump 5 by using the negative intake pressure as the driving power. Therefore, even in the low negative intake pressure engine such as the direct injection type engine, this embodiment can attain purging of the canister 3 by the purge pump 5 driven by the negative intake pressure without consuming electric power and without affecting fuel injection by the injector.

From the aspect of engine control, the fuel injection amount is small when the throttle valve 6 is closed. Therefore, the evaporated fuel is not easily accepted. On the other hand, the fuel injection amount is great when the throttle valve 6 is open, and the evaporated fuel is easily accepted. Therefore, the evaporated fuel is stored inside the second chamber 42 when the throttle valve is closed at which the evaporated fuel is not easily accepted, and is emitted to the intake pipe 1 when the throttle valve 6 is open at which the evaporated fuel is easily accepted. This construction is extremely advantageous from the aspect of engine control, too.

Figure 28:
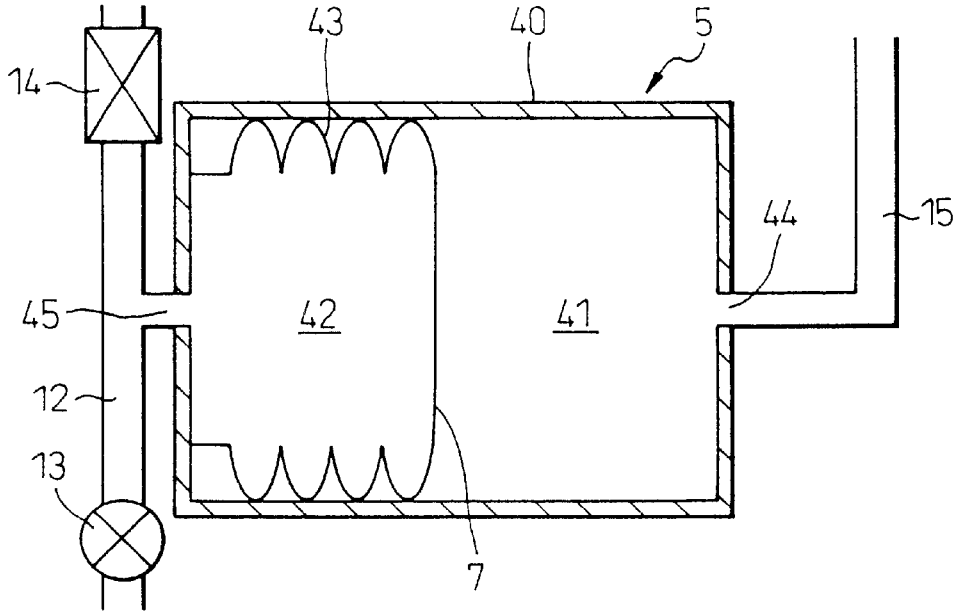
FIG. 28 is a schematic view showing a modified example of the purge pump according to the ninth embodiment.
Figure 29:
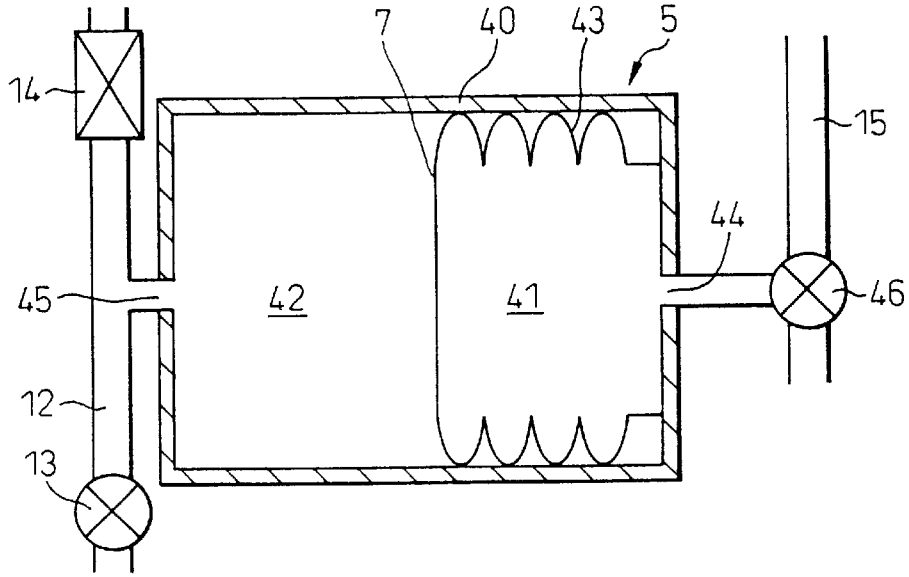
FIG. 29 is a schematic view showing another modified example of the purge pump according to the ninth embodiment.

In this ninth embodiment, the three-way valve 46 is disposed in the negative pressure introduction passage 15, but may be omitted as shown in FIG. 28. In this case, when the throttle valve 6 as the pump driving means is open and the negative intake pressure downstream of the throttle valve 6 disappears, so that the first chamber 41 is released. Since the intake air flows through the intake pipe 1, the negative intake pressure practically exists to a certain extent at a downstream portion of the throttle valve 6. Therefore, the bellows 43 are so designed as to contract against the negative intake pressure. In this ninth embodiment, the bellows 43 are attracted when the negative intake pressure is introduced into the first chamber 41. However, it is possible to use the construction in which the bellows 43 are contracted when the negative intake pressure is introduced into the first chamber 41 as shown in FIG. 29.

Embodiment 10

Figure 30:
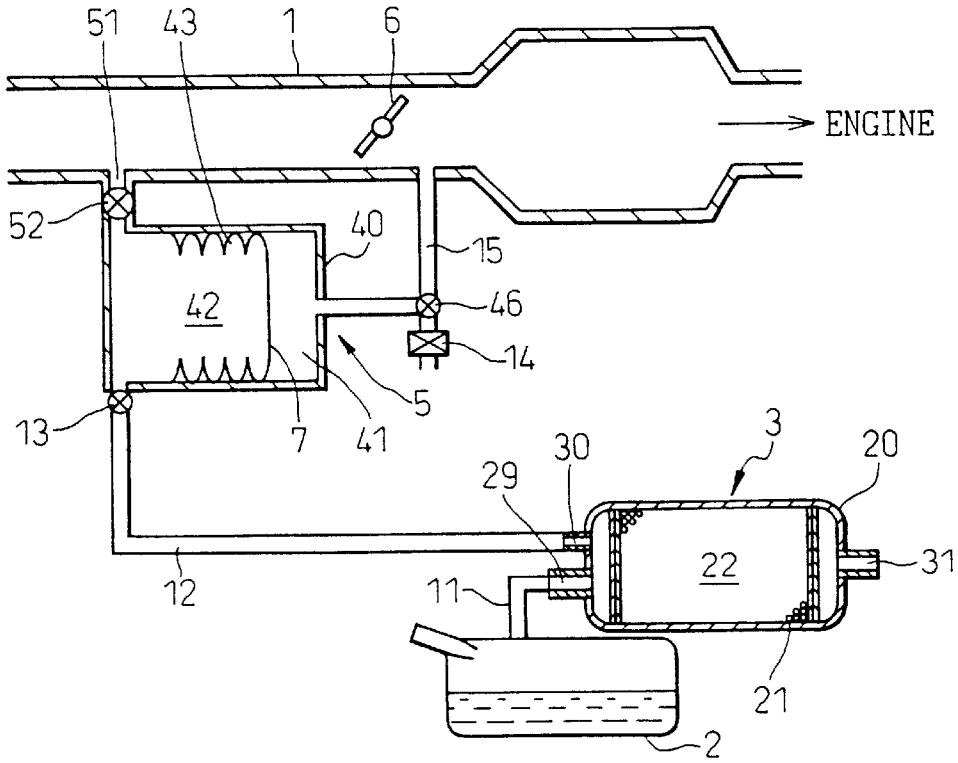
FIG. 30 is a schematic view showing a construction of an evaporated fuel processor of an internal combustion engine according to the tenth embodiment of the present invention.

FIG. 30 shows a schematic construction of an evaporated fuel processor according to the tenth embodiment of the present invention.

The tenth embodiment includes the purge pump 5 provided integrally with a resonator. The negative pressure introduction passage 15 connects the first chamber 41 of the purge pump 5 to the intake pipe 1 on the downstream side of the throttle valve 6. The three-way valve 46 is disposed at an intermediate part of the negative pressure introduction passage 15. One of the ends of this three-way valve 46 is connected to the open air through the purge valve 14 that controls the purge flow rate. The three-way valve 46 switches the suction duct side and the open-air side. The purge passage 12 connects the second chamber 42 of the purge pump 5 to the canister 3. A valve 13 is disposed at an intermediate part of the purge passage 12.

Here, the capacity of the second chamber 42 is set to be equal to the capacity at which it exhibits the silencing effect as the resonator when the partition 7 shifts to the extreme left end in the drawing, that is, when the capacity of the second chamber 42 reaches minimum. In this way, the second chamber 42 has also the function of the silencing function. A connection duct 51 that connects the intake pipe 1 to the second chamber (resonator) 42 communicates with the second chamber 42 of the purge pump 5, and a valve 52 is disposed at an intermediate part of the connection duct 51. The inner diameter of this valve 52 is coincident with the inner diameter of the connection duct 51 lest it impedes the silencing function as the resonator. The construction of each of the canister 3 and the purge pump 5 is the same as that of the first embodiment.

Next, the operation of the evaporated fuel processor according to the tenth embodiment will be explained briefly with reference to FIG. 30.

When the throttle valve 6 is closed, the valve 52 is closed, the valve 13 is opened and the three-way valve 46 is switched to the intake pipe side 1. The intake pipe negative pressure occurring in the intake pipe 1 downstream of the throttle valve 6, when the throttle valve 6 is closed, passes through the negative pressure introduction passage 15 and is then introduced into the first chamber 41 of the purge pump 5. When the negative intake pressure is introduced into the first chamber 41, the partition 7 is moved to the right in the drawing 30, that is, in the direction in which the capacity of the first chamber 41 becomes small, so that the capacity of the second chamber 42 becomes greater than that of the first chamber 41. When the capacity of the second chamber 42 becomes large in this way, the negative pressure develops inside the second chamber 42.

At this time, the valve 52 is closed but the valve 13 is open. Therefore, the open air is sucked from the canister 3 side. In other words, the open air flows from the open-air port 31 of the canister 3 into the canister 3. The evaporated fuel adsorbed by a large number of active carbon 21 of the fuel adsorbing layer 22 is desorbed at this time, and the air-fuel mixture (purge air) of the open air and the evaporated fuel flows into the second chamber 42 of the purge pump 5 through the purge passage 12. Since the valve 52 is closed in this instance, its silencing function as the resonator is lost. However, since the load of the engine is not much great, the noise requiring silencing is not much generated. Therefore, adverse influences hardly exist.

After the throttle valve 6 is opened, the valve 13 is closed, the valve 52 is opened, the three-way valve 46 is switched to the open-air side, and then the purge valve 14 is opened, thereby releasing the negative intake pressure of the first chamber 41. When the first chamber 41 is released, the partition 7 is moved to the left in the drawing by the force of the bellows 43 or the spring, and the purge air inside the second chamber 42 is pushed out into the intake pipe 1 through the connection duct 51 and is burnt inside the engine. At this time, the purge valve 14 controls the release of the negative intake pressure of the first chamber 41 and can control the evaporated fuel pushed out from inside the second chamber 42 into the intake pipe 1. While the throttle valve 6 is open, the engine load is great and the silencing function as the resonator is required. According to the construction described above, however, the silencing function of the second chamber 42 is restored when the valve 52 is opened for purging. Therefore, the pressure-feeding function as the purge pump and the silencing function as the resonator can be simultaneously satisfied.

Embodiment 11

Figure 31:
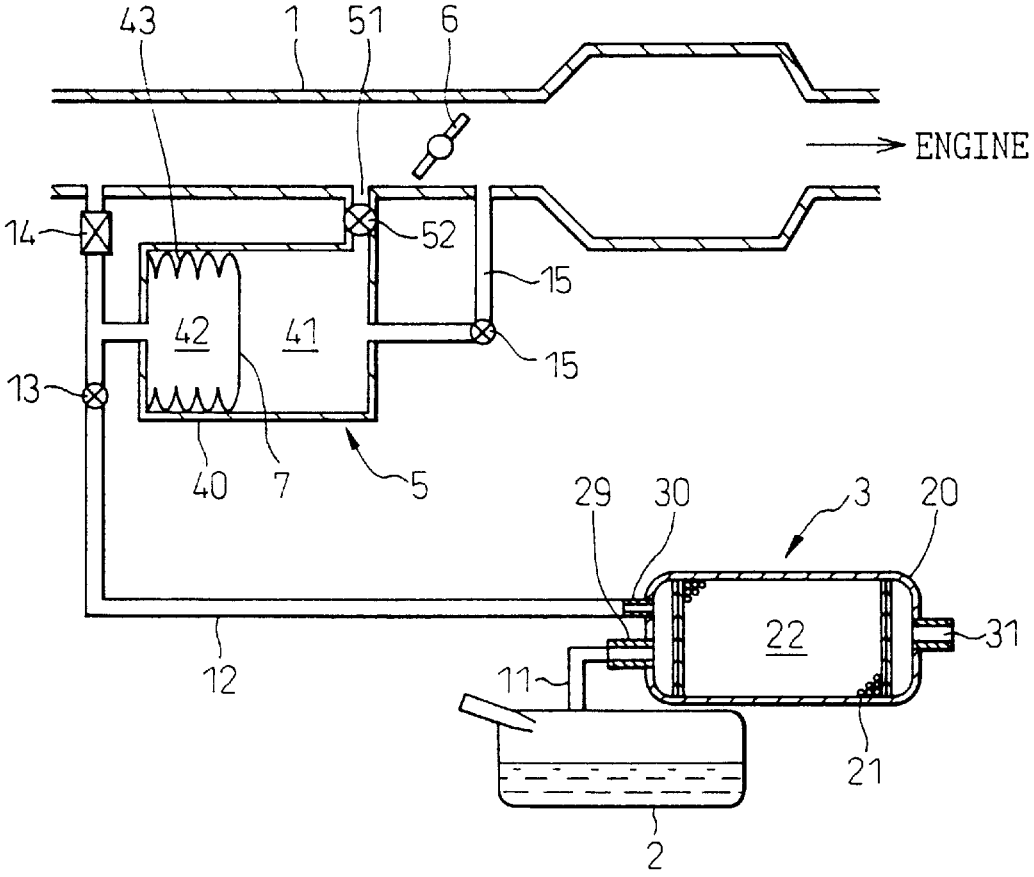
FIG. 31 is a schematic view showing a construction of an evaporated fuel processor of an internal combustion engine according to the eleventh embodiment of the present invention.

FIG. 31 shows a schematic construction of an evaporated fuel processor according to the eleventh embodiment of the present invention.

The eleventh embodiment includes a purge pump 5 provided integrally with a resonator. A negative pressure introduction passage 15 connects a first chamber 41 of the purge pump 5 to an intake pipe 1 on the downstream side of a throttle valve 6. A valve 56 is disposed at an intermediate part of a negative pressure introduction passage 15. A purge passage 12 connects a second chamber 42 of the purge pump 5 to a canister 3 and to an intermediate part of an intake pipe 1 on the upstream side of the throttle valve 6. A valve 13 is disposed between the purge pump 5 and the canister 3, and a purge valve 14 is disposed between the purge pump 5 and the intake pipe 1.

Here, the capacity of the first chamber 41 is set to be equal to the capacity at which it exhibits the silencing effect as the resonator when a partition 7 moves to the extreme left end in the drawing, that is, when the capacity of the first chamber 41 reaches a maximum. In this way, the first chamber 41 has also the silencing function. A connection duct 51 that connects the intake pipe 1 to the first chamber (resonator) 41 communicates with the first chamber 41 of the purge pump 5, and a valve 52 is disposed at an intermediate part of the connection duct 51. The inner diameter of this valve 52 is coincident with the inner diameter of the connection duct 51 lest it impedes the silencing function as the resonator. The construction of the purge pump 5 is the same as that of the first embodiment.

Next, the operation of the evaporated fuel processor according to the eleventh embodiment will be explained briefly with reference to FIG. 31.

When the throttle valve 6 is closed, the valve 52 is closed, the valve 13 is opened and the valve 55 is opened. The negative intake pressure occurring in the intake pipe 1 downstream of the throttle valve 6, when the throttle valve 6 is closed, passes through the negative pressure introduction passage 15 and is then introduced into the first chamber 41 of the purge pump 5. When the negative intake pressure is introduced into the first chamber 41, the partition 7 is moved to the right in the drawing 30, that is, in the direction in which the capacity of the first chamber 41 becomes small, so that the capacity of the second chamber 42 becomes greater than that of the first chamber 41. When the capacity of the second chamber 42 becomes large in this way, the negative pressure develops inside the second chamber 42.

At this time, the purge valve 14 is closed but the valve 13 is open. Therefore, the open air is sucked from the canister 3 side. In other words, the open air flows from the open-air port 31 of the canister 3 into the canister 3. The evaporated fuel adsorbed by a large number of active carbon 21 of the fuel adsorbing layer 22 is desorbed at this time, and the air-fuel mixture (purge air) of the open air and the evaporated fuel flows into the second chamber 42 of the purge pump 5 through the purge passage 12. As the valve 52 is closed in this instance, its silencing function as a resonator is lost. However, as the load of the engine is not very great, a noise requiring silencing is hardly generated. Therefore, an adverse influence hardly exists.

After the throttle valve 6 is opened, the valve 13 is closed, the valve 55 is closed, and then the valve 52 is opened, thereby releasing the negative intake pressure of the first chamber 41. When the first chamber 41 is released, the partition 7 is moved to the left in the drawing by the force of the bellows 43 or the spring, and the purge air inside the second chamber 42 is pushed out into the intake pipe 1 through the purge passage 12 and is burnt inside the engine. At this time, as opening/closing the purge valve 14 is controlled, the evaporated fuel pushed out from inside the second chamber 42 into the intake pipe 1 can be controlled. While the throttle valve 6 is open, the engine load is large and the silencing function as the resonator is required. According to the construction described above, however, the silencing function of the first chamber 41 is restored when the valve 52 is opened for releasing the first chamber 41. Therefore, the pressure-feeding function as the purge pump and the silencing function as the resonator can be simultaneously provided.

Embodiment 12

Figure 32:
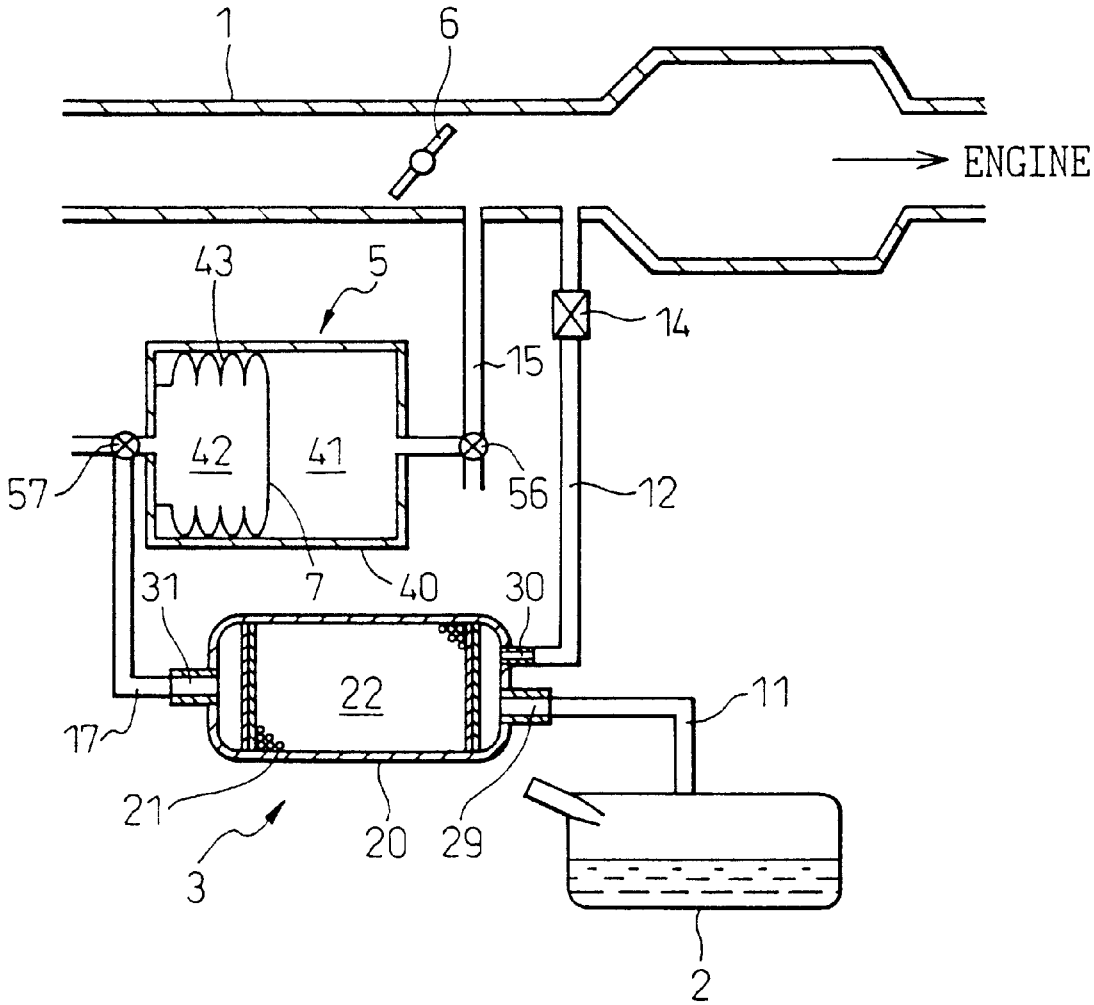
FIG. 32 is a schematic view showing a construction of an evaporated fuel processor of an internal combustion engine according to the twelfth embodiment of the present invention.

FIG. 32 shows a schematic construction of an evaporated fuel processor according to the twelfth embodiment of the present invention.

In this embodiment, as shown in FIG. 32, a purge passage 12 connects a purge port 30 of a canister 3 to an intake pipe 1 on the downstream side of a throttle valve 6. However, a purge port 30 may be connected to the intake pipe 1 on the upstream side of the throttle valve 6. A purge valve 14 for regulating the purge flow rate is disposed at an intermediate part of the purge passage 12. The construction of each of the canister 3 and the purge pump 5 is the same as that of the ninth embodiment.

The negative pressure introduction passage 15 connects a first chamber 41 of the purge pump 5 to the intake pipe 1 on the downstream side of the throttle valve 6. A three-way valve 56 corresponding to purge pump driving means of the present invention is disposed at an intermediate part of the negative pressure introduction passage 15, and one of the ends of this three-way valve 56 is connected to the open air. The three-way valve 56 is switched to a first switching state where the first chamber 41 of the purge pump 5 is connected to the suction duct side and to a second switching state where the first chamber 41 of the purge pump 5 is connected to the open-air side.

The open-air introduction passage 17 connects the second chamber 42 of the purge pump 5 to the open-air port 31 of the canister 3. A three-way valve 57 corresponding to purge pump driving means of the present invention is disposed at an intermediate part of the open-air introduction passage 17, and one of the ends of this three-way valve 57 is connected to the open air. The three-way valve 57 is switched to a first switching state where the second chamber 42 of the purge pump 5 is connected to the open air side and to a second switching state where the second chamber 42 of the purge pump 5 is connected to the canister 3 side.

The three-way valves 56 and 57 are switched to the first switching state when the throttle valve 6 of the engine is closed, introduce a high negative intake pressure into the first chamber 41 and constitute first partition driving means for moving the partition 7 in the first direction in which the capacity proportion of the second chamber 42 becomes greater than that of the first chamber 41, and for temporarily storing the open air inside the second chamber 42. The three-way valves 56 and 57 are switched to the second switching state when the throttle valve 6 of the engine is opened, release the negative intake pressure from inside the first chamber 41 and constitute second partition driving means for moving the partition 7 in the second direction in which the capacity proportion of the second chamber 42 becomes smaller than that of the first chamber 41, and for sending the open air inside the second chamber 42 to the canister 3 and purging the canister 3.

Next, the operation of the evaporated fuel processor according to the twelfth embodiment will be explained briefly with reference to FIG. 32.

When the throttle valve 6 is closed, the three-way valve 57 is switched to the open-air side 31 and the three-way valve 56 is switched to the suction duct side. The negative intake pressure generated in the intake pipe 1 downstream of the throttle valve 6, when the throttle valve 6 is closed, passes through the negative pressure introduction passage 15 and is then introduced into the first chamber 41 of the purge pump 5. When the negative intake pressure is introduced into the first chamber 41, the partition 7 is moved to the right in the drawing 32, that is, in the direction in which the capacity of the first chamber 41 becomes small, so that the capacity of the second chamber 42 becomes greater than that of the first chamber 41. When the capacity of the second chamber 42 becomes great in this way, the open air is sucked into the second chamber 42 because the three-way valve 57 is switched to the open-air side. At this time, the purge valve 14 is kept closed.

When the throttle valve 6 is opened, the three-way valve 57 is switched to the canister 3 side, the purge valve 14 is opened, the three-way valve 56 is switched to the open-air side, and the negative intake pressure inside the first chamber 41 is released to the open air. When the first chamber 41 is opened, the partition 7 is moved to the left in the drawing by the force of the bellows 43 or the spring, and the open air in the second chamber 42 is pushed out from the open-air introduction passage 17 towards the canister 3. As a result, the evaporated fuel adsorbed by a large number of active carbon particles 21 of the fuel adsorbing layer 22 is desorbed at this time, and the air-fuel mixture (purge air) of the open air and the evaporated fuel flows into the intake pipe 1 through the purge passage 12 and is burnt inside the engine while its flow rate is being controlled by the purge valve 14.

Embodiment 13

Figure 33:
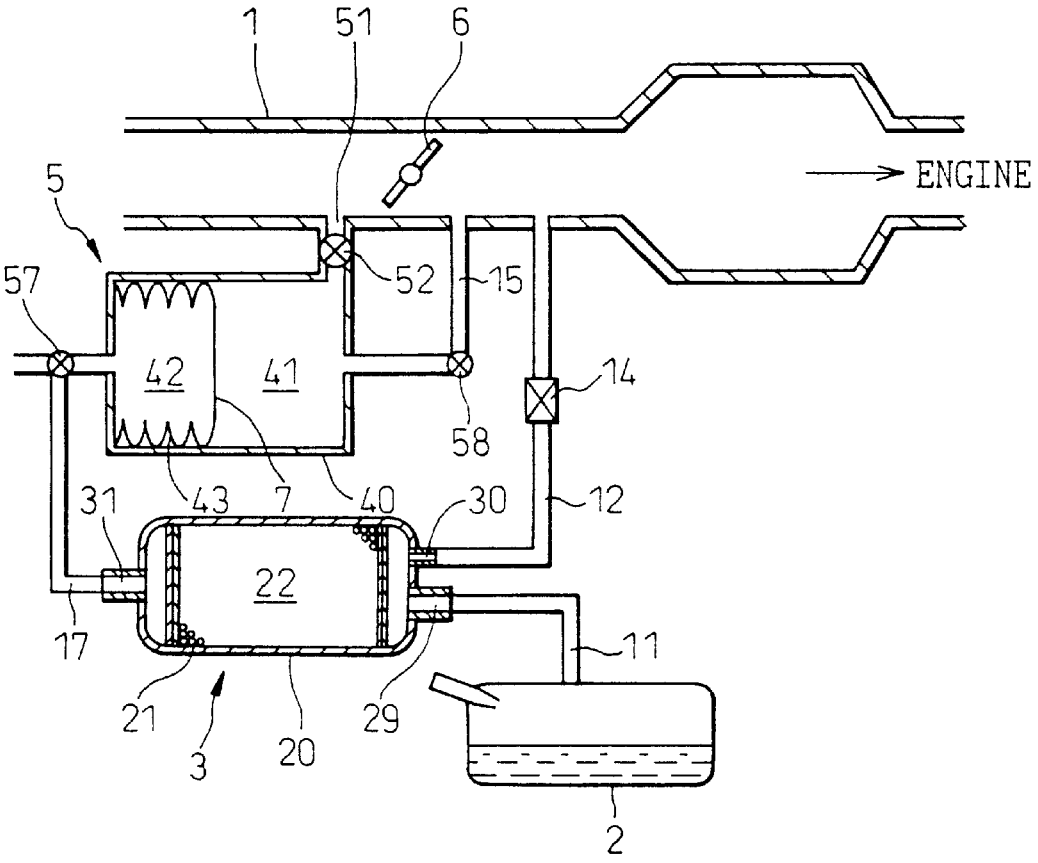
FIG. 33 is a schematic view showing a construction of an evaporated fuel processor of an internal combustion engine according to the thirteenth embodiment of the present invention.

FIG. 33 shows a schematic construction of an evaporated fuel processor according to the thirteenth embodiment of the present invention.

The thirteenth embodiment includes a purge pump 5 provided integrally with a resonator. A negative pressure introduction passage 15 connects a first chamber 41 of a purge pump 5 to an intake pipe 1 on the downstream side of a throttle valve 6. A valve 58 is disposed at an intermediate part of the negative pressure introduction passage 15. The open-air introduction passage 17 connects a second chamber 42 of the purge pump 5 to an open-air port 31 of a canister 3. A three-way valve 57 switches the canister 3 side and the open-air side. In FIG. 33, a purge passage 12 is connected to the downstream side of the throttle valve 6, but it may be connected to the upstream side of the throttle valve 6. The purge valve 14 for controlling the purge flow rate is disposed at an intermediate part of the purge passage 12.

Here, the capacity of the first chamber 41 is set to be equal to the capacity at which it exhibits the silencing effect as the resonator when the partition 7 shifts to the extreme left end in the drawing, that is, when the capacity of the first chamber 41 reaches maximum. In this way, the first chamber 41 has also the silencing function as a resonator. A connection duct 51 that connects the intake pipe 1 to the first chamber (resonator) 41 communicates with the first chamber 41 of the purge pump 5, and a valve 52 is disposed at an intermediate part of the connection duct 51. The inner diameter of this valve 52 is coincident with the inner diameter of the connection duct 51 lest it impedes the silencing function as the resonator. The construction of each of the canister 3 and the purge pump 5 is the same as that of the ninth embodiment.

Next, the operation of the evaporated fuel processor according to the thirteenth embodiment will be explained briefly with reference to FIG. 31.

When the throttle valve 6 is closed, the three-way valve 57 is switched to the open-air side, the valve 52 is closed, and the valve 58 is switched to the intake pipe 1 side. The negative intake pressure generated in the intake pipe 1 downstream of the throttle valve 6 when it is closed passes through the negative pressure introduction passage 15 and is then introduced into the first chamber 41 of the purge pump 5. When the negative intake pressure is introduced into the first chamber 41, the partition 7 is moved to the right in the drawing 33, that is, in the direction in which the capacity of the first chamber 41 becomes small, so that the capacity of the second chamber 42 becomes greater than that of the first chamber 41. When the capacity of the second chamber 42 becomes great in this way, a negative pressure develops inside the second chamber 42. Since the three-way valve 57 is switched to the open-air side at this time, the open air is sucked. At this time, the purge valve 14 is closed. Since the valve 52 is closed, the silencing function as the resonator is lost. However, the load of the engine is not large and the noise requiring silencing is hardly generated. Therefore, an adverse influence hardly exists.

After the throttle valve 6 is opened, the three-way valve 57 is switched to the canister 3 side, the purge valve 14 is opened, the valve 55 is closed, and then the valve 52 is opened, thereby releasing the negative intake pressure of the first chamber 41. When the first chamber 41 is released, the partition 7 is moved to the left in the drawing by the force of the bellows 43 or the spring, and the open air flows from the open-air port 31 of the canister 3 into the canister 3. At this time, the evaporated fuel adsorbed by a large number of active carbon 231 of the fuel adsorbing layer 22 is desorbed, and an air-fuel mixture (purge air) of the evaporated fuel and the open air is sent into the intake pipe 1 through the purge passage 12, while its flow rate is being controlled by the purge valve 14, and is then burnt inside the engine. While the throttle valve 6 is open, the engine load is large and a silencing function as the resonator is required. According to the construction described above, however, the silencing function of the first chamber 41 is restored when the valve 52 is opened for releasing the first chamber 41. Therefore, the pressure-feeding function as the purge pump 5 and the silencing function as the resonator can be simultaneously satisfied.

While the present invention has been described by reference to specific embodiments chosen for purposes of illustration, it should be apparent that numerous modifications could be made thereto by those skilled in the art without departing from the basic concept and scope of the invention.

What is claimed is:

1. An evaporated fuel processor comprising:

a canister for accommodating an adsorbing member for adsorbing an evaporated fuel generated inside a fuel tank; and a purge pump for compulsively desorbing the evaporated fuel adsorbed by said adsorbing member of said canister, and introducing the evaporated fuel into an intake passage of an internal combustion engine;

wherein said purge pump includes a driving chamber for introducing intake pulsation of an intake passage or exhaust pulsation of an exhaust passage of said internal combustion engine, a pump chamber disposed adjacent to said driving chamber and connected to an intermediate part of a connection passage between said canister and said intake passage of said internal combustion engine, and a partition for separating said driving chamber from said pump chamber, and varying a capacity proportion between both of said chambers, and movement of said partition by the introduction of intake pulsation or exhaust pulsation into said driving chamber sucks the evaporated fuel from said canister into said pump chamber and delivers the evaporated fuel from said pump chamber into said intake passage of said internal combustion engine.

2. An evaporated fuel processor according to claim 1, wherein said purge pump sucks the evaporated fuel into said pump chamber by means of the movement of said partition when only a negative pressure of intake pulsation of said intake passage or exhaust pulsation of said exhaust passage of said internal combustion engine is introduced into said driving chamber with a predetermined valve operation, and delivers the evaporated fuel from said pump chamber by means of the return of said partition by predetermined biasing force when the negative pressure is released with a predetermined valve operation.

3. An evaporated fuel processor according to claim 1, wherein said purge pump delivers the evaporated fuel from said pump chamber by means of the movement of said partition when only a positive pressure of intake pulsation of said intake passage or exhaust pulsation of said exhaust passage of said internal combustion engine is introduced into said driving chamber with a predetermined valve operation, and sucks the evaporated fuel into said pump chamber by means of the return of said partition by predetermined biasing force when the positive pressure is released with a predetermined valve operation.

4. An evaporated fuel processor comprising:

a canister for accommodating an adsorbing member for adsorbing an evaporated fuel generated inside a fuel tank; and a purge pump for compulsively desorbing the evaporated fuel adsorbed by said adsorbing member of said canister, and introducing the evaporated fuel into an intake passage of an internal combustion engine;

wherein said purge pump includes a driving chamber for introducing intake pulsation of an intake passage or exhaust pulsation of an exhaust passage of said internal combustion engine, a pump chamber disposed adjacent to said driving chamber and connected to an open air side of said canister, and a partition for separating said driving chamber from said pump chamber, and varying a capacity proportion between both of said chambers, and movement of said partition by the introduction of intake pulsation or exhaust pulsation into said driving chamber sucks the external air into said pump chamber, moves the air in said pump chamber into said canister and delivers the evaporated fuel from said canister into said intake passage of said internal combustion engine.

5. An evaporated fuel processor comprising:

an evaporated fuel passage for communicating an intake pipe of an engine with a fuel tank;

a canister disposed at an intermediate part of said evaporated fuel passage, for adsorbing an evaporated fuel generated inside said fuel tank; and a purge pump for introducing a fuel pressurized by a fuel pump, reciprocating a movable member by the pressure of the fuel, and purging the evaporated fuel adsorbed by said canister.

6. An evaporated fuel processor according to claim 5, wherein said purge pump includes a first chamber for introducing purge air and a second chamber for introducing a pressurized fuel by said fuel pump, said first and second chambers are separated by a movable member under a sealed state, and said movable member is reciprocated in accordance with the pressure of the fuel introduced into said second chamber to thereby change the capacity of said first chamber.

7. An evaporated fuel processor according to claim 6, wherein said purge pump is interposed between said canister and said engine intake pipe, said purge pump sucks the evaporated fuel as purge air from said canister into said first chamber when the fuel pressure of said second chamber is released, and delivers the purge air from said first chamber into said intake pipe when the fuel pressure of said second chamber is introduced.

8. An evaporated fuel processor according to claim 6, wherein said purge pump is disposed at an open air portion of said canister, and said purge pump sucks open air as purge air into said first chamber when the fuel pressure of said second chamber is released and delivers purge air from said first chamber into said intake pipe through said canister when the fuel pressure of said second chamber is introduced.

9. An evaporated fuel processor, according to claim 6, which further includes a purge control valve for regulating a purge amount of the evaporated fuel into said intake pipe and controlling means for controlling the opening of said purge control valve, and wherein said controlling means serially executes a step of releasing the fuel pressure of said second chamber during a purge stop period in which said purge control valve is closed to thereby increase the capacity of said first chamber to maximum, and introducing purge air into said first chamber, and a step of introducing the fuel pressure into said second chamber during a subsequent purge execution period by said purge control valve to thereby decrease the capacity of said first chamber to minimum, and delivering the purge air in said first chamber.

10. An evaporated fuel processor according to claim 6, wherein said purge pump is constituted in such a fashion that the capacity change of said second chamber during driving thereof is smaller than the capacity change of said first chamber.

11. A fault diagnostic apparatus for diagnosing said evaporated fuel processor according to claim 5, comprising:

means for converting a portion from a fuel tank to said intake pipe through an evaporated fuel passage to a closed space, and then pressurizing or evacuating said closed space by use of said purge pump, and;

means for detecting abnormality of said evaporated fuel processor on the basis of the pressure change of said closed space under such a state.

12. A fault diagnostic apparatus for said evaporated fuel processor according to claim 11, which first forms said closed space, and then judges the leak of said closed space by judging whether or not the internal pressure of said closed space reaches a predetermined value with the pressurizing operation of said purge pump.

13. A fault diagnostic apparatus for said evaporated fuel processor according to claim 11, which, after the pressurizing operation of said closed space is finished by use of said purge pump, judges the leak in said closed space by judging whether or not the pressure in said closed space reaches a predetermined value after the passage of a predetermined time.

14. An evaporated fuel processor including a canister having an evaporated fuel adsorbing layer for temporarily adsorbing and holding an evaporated fuel emitted from a fuel tank into an evaporated fuel passage, and disposed inside a case having one of the ends thereof connected to the evaporated fuel passage extending to said fuel tank and the other end thereof connected to a purge passage extending to an intake pipe of an engine, for delivering the evaporated fuel into said intake pipe through said purge passage by utilizing a negative intake pressure occurring in said intake pipe during the operation of said engine, said evaporated fuel processor comprising:

a purge pump for compulsively desorbing the evaporated fuel adsorbed by said fuel adsorbing layer therefrom; and purge pump driving means for driving said purge pump by utilizing the negative intake pressure occurring in said intake pipe when a throttle of said engine is opened and closed.

15. An evaporated fuel processor according to claim 14, wherein said purge pump includes a first chamber connected to a negative pressure introduction passage communicating with said intake pipe, for introducing the negative intake pressure thereinto, and a second chamber connected to said canister and to said intake pipe, for delivering the evaporated fuel into said intake pipe, said first and second chambers being partitioned by a partition capable of freely varying a capacity proportion between said first and second chambers;

said purge pump driving means includes first partition driving means for introducing the intake pipe negative pressure into said first chamber when the throttle of said engine is closed and moving said partition in a first direction in which the capacity proportion of said second chamber is greater than that of said first chamber, and second partition driving means for releasing the negative intake pressure from inside said first chamber when the throttle of said engine is opened, and moving said partition in a second direction in which the capacity proportion of said second chamber is smaller than that of said first chamber; and said second chamber is integrated with a resonator and the capacity of said second chamber when it becomes minimal is coincident with a capacity at which said resonator exhibits a silencing effect, thereby providing said second chamber with the silencing function.

16. An evaporated fuel processor according to claim 14, wherein said purge pump includes a first chamber connected to a negative pressure introduction passage communicating with said intake pipe, for introducing the negative intake pressure thereinto, and a second chamber connected to said canister and to said intake pipe, for delivering the evaporated fuel into said intake pipe, said first and second chambers being partitioned by a partition capable of freely varying a capacity proportion between said first and second chambers;

said purge pump driving means includes first partition driving means for introducing the negative intake pressure into said first chamber when the throttle of said engine is closed and moving said partition in a first direction in which the capacity proportion of said second chamber is greater than that of said first chamber, and second partition driving means for releasing the negative intake pressure from inside said first chamber when the throttle of said engine is opened, and moving said partition in a second direction in which the capacity proportion of said second chamber is smaller than that of said first chamber; and said first chamber is integrated with a resonator and the capacity of said first chamber when it becomes maximal is coincident with a capacity at which said resonator exhibits a silencing effect, thereby providing said first chamber with the silencing function.

17. An evaporated fuel processor according to claim 14, wherein said purge pump includes a first chamber connected to a negative pressure introduction passage communicating with said intake pipe, for introducing the negative intake pressure thereinto, and a second chamber connected to said canister or the air, for delivering the air thereinto, said first and second chambers being partitioned by a partition capable of freely varying a capacity proportion between said first and second chambers; and said purge pump driving means includes first partition driving means for introducing the negative intake pressure into said first chamber when the throttle of said engine is closed and moving said partition in a first direction in which the capacity of said second chamber is greater than that of said first chamber, and second partition driving means for releasing the negative intake pressure from inside said first chamber when the throttle of said engine is opened, and moving said partition in a second direction in which the capacity of said second chamber is smaller than that of said first chamber.

18. An evaporated fuel processor according to claim 17, wherein said first chamber and said resonator are integrated with each other, and the capacity of said first chamber, when it becomes maximal, is brought into coincidence with a capacity at which a silencing effect as said resonator is exhibited, thereby providing said first chamber with a silencing function.

* * * * *